US011781200B2

(12) United States Patent
Tokuda et al.

(10) Patent No.: US 11,781,200 B2
(45) Date of Patent: Oct. 10, 2023

(54) PLATED STEEL

(71) Applicant: NIPPON STEEL CORPORATION, Tokyo (JP)

(72) Inventors: Kohei Tokuda, Tokyo (JP); Takuya Mitsunobu, Tokyo (JP); Mamoru Saito, Tokyo (JP); Yuto Fukuda, Tokyo (JP); Yasuto Goto, Tokyo (JP); Hidetoshi Shindo, Tokyo (JP); Fumiaki Nakamura, Tokyo (JP); Koji Kawanishi, Tokyo (JP); Ryohei Mimura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/014,466

(22) PCT Filed: Jul. 9, 2021

(86) PCT No.: PCT/JP2021/025900
§ 371 (c)(1),
(2) Date: Jan. 4, 2023

(87) PCT Pub. No.: WO2023/281729
PCT Pub. Date: Jan. 12, 2023

(65) Prior Publication Data

US 2023/0193425 A1 Jun. 22, 2023

(51) Int. Cl.
*C22C 18/04* (2006.01)

(52) U.S. Cl.
CPC ..... *C22C 18/04* (2013.01)

(58) Field of Classification Search
None
See application file for complete search history.

(56) References Cited

U.S. PATENT DOCUMENTS

| | | | | |
|---|---|---|---|---|
| 6,235,410 | B1 | 5/2001 | Komatsu et al. | |
| 6,465,114 | B1 | 10/2002 | Honda et al. | |
| 2015/0352812 | A1 | 12/2015 | Jung et al. | |
| 2018/0087850 | A1 | 3/2018 | Ueno et al. | |
| 2018/0371598 | A1 | 12/2018 | Kim | |
| 2019/0390303 | A1 | 12/2019 | Tokuda et al. | |
| 2022/0112589 | A1* | 4/2022 | Mitsunobu | C23C 2/06 |
| 2022/0119921 | A1* | 4/2022 | Mitsunobu | C23C 30/00 |
| 2022/0145425 | A1* | 5/2022 | Mitsunobu | C23C 28/023 |
| 2022/0152983 | A1* | 5/2022 | Mitsunobu | C23C 2/20 |

FOREIGN PATENT DOCUMENTS

| | | | | |
|---|---|---|---|---|
| CN | 104903493 | A | 9/2015 | |
| CN | 108779542 | A | 11/2018 | |
| CN | 110268087 | A | 9/2019 | |
| JP | 10-306357 | A | 11/1998 | |
| JP | 2021-4403 | A | 1/2021 | |
| KR | 10-2017-0138827 | A | 12/2017 | |
| WO | WO 00/71773 | A1 | 11/2000 | |
| WO | WO2011/001662 | A1 | 1/2011 | |
| WO | WO2016/157665 | A1 | 10/2016 | |
| WO | WO2018/139619 | A1 | 8/2018 | |
| WO | WO-2020213680 | A1 * | 10/2020 | B32B 15/013 |
| WO | WO-2020213686 | A1 * | 10/2020 | C22C 18/00 |
| WO | WO-2020213687 | A1 * | 10/2020 | C22C 18/00 |
| WO | WO-2020213688 | A1 * | 10/2020 | B32B 15/013 |

OTHER PUBLICATIONS

Mariola Saternus et al., "Effect of Mg on the Formation of Periodic Layered Structure during Double Batch Hot Dip Process in Zn—Al Bath", Materials, Mar. 1, 2021, vol. 14, No. 5, pp. 1-16.
Notice of Allowance issued in JP Application No. 2022-505253 dated Mar. 1, 2022.

* cited by examiner

*Primary Examiner* — Brian D Walck
(74) *Attorney, Agent, or Firm* — Birch, Stewart, Kolasch & Birch, LLP

(57) ABSTRACT

A plated steel including a plated layer on a surface of a steel, in which Expression 1 of $0 \leq Cr+Ti+Ni+Co+V+Nb+Cu+Mn \leq 0.25$ and Expression 2 of $0 \leq Sr+Sb+Pb+B+Li+Zr+Mo+W+Ag+P \leq 0.50$ are satisfied, and Expression 3 of $I(MgZn_2\ (41.31°))/I\Sigma(MgZn_2) \leq 0.265$ and Expression 6 of $0.150 \leq \{I(MgZn_2\ (20.79°))+I(MgZn_2\ (42.24°))\}/I\Sigma(MgZn_2)$ are further satisfied in an X-ray diffraction pattern of a surface of the plated layer measured using Cu-Kα rays under a condition that an X-ray output is 40 kV and 150 mA.

16 Claims, No Drawings

PLATED STEEL

TECHNICAL FIELD

The present invention relates to a plated steel.

BACKGROUND ART

A plated steel is generally manufactured by a continuous plating method in which a steel strip is continuously immersed in a plating bath. A plated steel is also manufactured by a so-called hot dip galvanizing method in which a steel that has been previously processed by processing such as cutting processing, bending processing, or welding is immersed in a plating bath. Since a plated steel manufactured by the continuous plating method is subjected to processing of various types after plating, a base steel thereof may be exposed at a cut end surface portion or a processed portion due to bending processing or the like. On the other hand, even in a plated steel manufactured by the hot dip galvanizing method, processing of various types are performed after plating, and a base steel thereof may be exposed. As described above, in terms of corrosion resistance of the plated steel manufactured by the continuous plating method or the hot dip galvanizing method, it is important how corrosion of the portion at which the base steel is exposed will be prevented.

In a plated steel, there are mainly two types of highly corrosion-resistant plating. One is Zn-based plating and the other is Al-based plating. Since Zn has a higher ionization tendency than Fe, the Zn-based plating has a sacrificial corrosion resistance action on a steel and can prevent corrosion even in a place at which the base steel is exposed such as a cut end surface portion and a processed portion of the plated steel. On the other hand, the Al-based plating utilizes a barrier effect of Al that forms a stable oxide film in an atmospheric environment and is excellent in corrosion resistance of a planar portion. In the Al-based plating, sacrificial corrosion resistance does not easily act on Fe due to an oxide film. Therefore, corrosion resistance at a cut end surface portion or the like cannot be expected. Therefore, Al-based plating has limited applications such as a material having a small plate thickness.

Also, in the Zn-based plating, attempts have been made to increase sacrificial corrosion resistance while improving planar portion corrosion resistance, but these two performances are contradictory in characteristics, and thus one of them is often lost. Therefore, since around 2000, Zn—Al—Mg based plating as described in Patent Document 1 has come to be widely used in the market. In the Zn—Al—Mg based plating, when Mg, which has a high ionization tendency, is added while adding Al to improve corrosion resistance of the plated layer, it is possible to improve the corrosion resistance without lowering the sacrificial corrosion resistance action in addition to the planar portion corrosion resistance.

In recent years, a Zn—Al—Mg based plated steel sheet such as that disclosed in Patent Document 2 has been developed focusing on Mg that has a high ionization tendency. An increase in an amount of Mg is expected to further improve corrosion resistance and sacrificial corrosion resistance, but addition of Mg leads to, for example, hardening of the plated layer and may cause cracking or peeling of the plated layer especially at a processed portion due to deterioration of processability, and therefore a concentration of the added Mg needs to be kept within a certain range.

The reason why the addition of Mg deteriorates processability of the plated layer is that a hard intermetallic compound called $MgZn_2$ is formed in the plated layer due to addition of Mg, and this brittle $MgZn_2$ serves as a starting point for fracture. Therefore, a large amount of Mg could not be added.

CITATION LIST

Patent Document

[Patent Document 1]
PCT International Publication No. WO 2000/71773
[Patent Document 2]
PCT International Publication No. WO 2018/139619

SUMMARY OF THE INVENTION

Problems to be Solved by the Invention

The present invention has been made in view of the above circumstances, and it is an objective of the present invention to provide a Zn—Al—Mg based plated steel that is excellent in corrosion resistance especially in a processed portion.

Means for Solving the Problem

In order to solve the above-described problems, the present invention includes the following aspects.

[1] A plated steel according to one aspect of the present invention includes a plated layer on a surface of a steel, in which an average chemical composition of the plated layer is formed of, by mass %,
50.00% or more of Zn,
more than 10.00% and less than 40.00% of Al,
more than 5.00% and less than 12.50% of Mg,
0% or more and 3.00% or less of Sn,
0% or more and 1.00% or less of Bi,
0% or more and 1.00% or less of In,
0.03% or more and 2.00% or less of Ca,
0% or more and 0.50% or less of Y,
0% or more and 0.50% or less of La,
0% or more and 0.50% or less of Ce,
0% or more and 2.50% or less of Si,
0% or more and 0.25% or less of Cr,
0% or more and 0.25% or less of Ti,
0% or more and 0.25% or less of Ni,
0% or more and 0.25% or less of Co,
0% or more and 0.25% or less of V,
0% or more and 0.25% or less of Nb,
0% or more and 0.25% or less of Cu,
0% or more and 0.25% or less of Mn,
more than 0% and 5.00% or less of Fe,
0% or more and 0.50% or less of Sr,
0% or more and 0.50% or less of Sb,
0% or more and 0.50% or less of Pb,
0% or more and 0.50% or less of B,
0% or more and 0.50% or less of Li,
0% or more and 0.50% or less of Zr,
0% or more and 0.50% or less of Mo,
0% or more and 0.50% or less of W,
0% or more and 0.50% or less of Ag,
0% or more and 0.50% or less of P,
and impurities,
the following Expression 1 and Expression 2 are satisfied, and Expression 3 and Expression 6 are further satisfied in an X-ray diffraction pattern of a surface of the plated layer measured using Cu-Kα rays under a condition that an X-ray output is 40 kV and 150 mA.

$$0 \leq Cr+Ti+Ni+Co+V+Nb+Cu+Mn \leq 0.25 \quad \text{Expression 1}$$

$$0 \leq Sr+Sb+Pb+B+Li+Zr+Mo+W+Ag+P \leq 0.50 \quad \text{Expression 2}$$

$$I(MgZn_2(41.31°))/I\Sigma(MgZn_2) \leq 0.265 \quad \text{Expression 3}$$

$$0.150 \leq \{I(MgZn_2(20.79°))+1(MgZn_2(42.24°))\}/I\Sigma(MgZn_2) \quad \text{Expression 6}$$

(Here, this is provided that, the element symbols in Expression 1 and Expression 2 each indicate an amount (mass %) of each element by mass % in the plated layer, and 0 is substituted when the element is not contained, and $I\Sigma(MgZn_2)$, $I(MgZn_2\ (41.31°))$, $I(MgZn_2\ (20.79°))$, and $I(MgZn_2\ (42.24°))$ in Expression 3 and Expression 6 are as follows, and $I\Sigma(Mg_2Sn)$ is 0 when the plated layer does not contain Sn.

$I\Sigma(MgZn_2)$: A sum of intensities of diffraction peaks of a (100) plane, a (002) plane, a (101) plane, a (102) plane, a (110) plane, a (103) plane, a (112) plane, a (201) plane, a (004) plane, a (203) plane, a (213) plane, a (220) plane, a (313) plane, and a (402) plane of $MgZn_2$.

$I(MgZn_2\ (41.31°))$: An intensity of the diffraction peak of the (201) plane of $MgZn_2$.

$I(MgZn_2\ (20.79°))$: An intensity of the diffraction peak of the (002) plane of $MgZn_2$.

$I(MgZn_2\ (42.24°))$: An intensity of the diffraction peak of the (004) plane of $MgZn_2$.)

[2] In the plated steel according to the above-described (1), an average composition of Sn of the plated layer may be 0.03% or more and 1.50% or less of Sn.

[3] In the plated steel according to the above-described (1) or (2),

Expression 4 and Expression 5 may be further satisfied in an X-ray diffraction image of the surface of the plated layer measured using Cu-Kα rays under a condition that an X-ray output is 40 kV and 150 mA.

$$1.0 \leq I(Al0.71Zn0.29(38.78°))/I(Al(38.47°)) \quad \text{Expression 4}$$

$$1.0 \leq I((Al0.71Zn0.29(38.78°))/I(Zn(38.99°)) \quad \text{Expression 5}$$

(Here, $I(Al0.71Zn0.29\ (38.78°))$, $I(Al\ (38.47°))$, and $I(Zn\ (38.99°))$ in Expression 4 and Expression 5 are as follows.

$I(Al0.71Zn0.29\ (38.78°))$: An intensity of a diffraction peak of a (101) plane of Al0.71Zn0.29.

$I(Al\ (38.47°))$: An intensity of a diffraction peak of a (111) plane of Al.

$I(Zn\ (38.99°))$: An intensity of a diffraction peak of a (100) plane of Zn.)

[4] In the plated steel according to any one of the above-described (1) to (3), the following Expression 3' may be satisfied instead of the above-described Expression 3.

$$I(MgZn_2(41.31°))/I\Sigma(MgZn_2) \leq 0.140 \quad \text{Expression 3'}$$

[5] In the plated steel according to any one of the above-described (1) to (4), the following Expression 6' may be satisfied instead of the above-described Expression 6.

$$0.350 \leq \{I(MgZn_2(20.79°))+I(MgZn_2(42.24°))\}/I\Sigma(MgZn_2) \quad \text{Expression 6'.}$$

Effects of the Invention

According to the present invention, a plated steel that is excellent in corrosion resistance of a processed portion can be provided.

Embodiment for Implementing the Invention

For a plated steel, since planar portion corrosion resistance and a sacrificial corrosion resistance action increase as an amount of $MgZn_2$ phase increases in a plated layer, when the plated layer is improved with appropriate incorporation of the $MgZn_2$ phase, there remains a possibility of obtaining even higher corrosion-resistant plating. Also, until now, no research has been conducted on a structure in which corrosion resistance is exhibited to the maximum by structure control of a plated layer, and it has not been sufficiently clarified how a phase that does not have high corrosion resistance such as a Zn phase and an Al phase and a phase that cannot sufficiently exhibit sacrificial corrosion resistance can be configured to maximize performance in a Zn—Al—Mg based plating. Therefore, as a result of intensive research by the present inventor to improve corrosion resistance in a processed portion of the plated steel, when it is assumed that a processed portion is formed by bending processing or the like for the plated steel having a plated layer, the inventors have come to have a perception that it is necessary to improve sacrificial corrosion resistance and planar portion corrosion resistance of the plated layer itself in the processed portion. Then, in order to improve both performances described above, it has been found that the $MgZn_2$ phase contained in the plated layer is preferably precipitated in a large amount inside the plated layer.

On the other hand, when an amount of the $MgZn_2$ phase, which is an intermetallic compound, increases in a plated layer, the plated layer is hardened, processability of the plated layer tends to be inferior, the plated layer of the processed portion is likely to crack or peel off, and thus, even if sacrificial corrosion resistance is improved, the corrosion resistance of the processed portion tends to be inferior. For example, when the plated steel is subjected to bending processing or the like, cracks are generated in a thickness direction of a steel sheet as a result of stress applied to the plated layer in the processed portion. When these cracks reach from a surface of the plated layer to a base steel thereof, the corrosion resistance of the processed portion is significantly deteriorated. Therefore, the present inventors have come to have a perception that it is necessary to soften the plated layer or use a plating layer in which cracks do not easily propagate. Therefore, the inventors of the present invention have found that, when a propagation direction of cracks in the plated layer is made to be changed, a path of corrosion development is complicated, and the corrosion resistance of the processed portion can be improved. Specifically, a plated layer having a crystal structure that can suppress propagation of cracks in a thickness direction of the steel sheet has been successfully obtained by reducing a proportion of the $MgZn_2$ phase present in which a (201) plane is oriented in a crystal of the $MgZn_2$ phase to be identified to increase a proportion of the $MgZn_2$ phase oriented in a (002) plane and a (004) plane which is a plane equivalent to the (002) plane in the crystal of the $MgZn_2$ phase to be relatively identified when X-ray diffraction is performed on a surface of the plated layer.

That is, the present inventors have developed a plated steel that can solve the above-described problems by further improving the processability of a plated steel sheet containing a large amount of $MgZn_2$ phase and having high corrosion resistance by controlling the crystal orientation. A plated steel according to an embodiment of the present invention will be described below.

A plated steel according to the present embodiment is a plated steel having a plated layer on a surface of a steel, in which an average chemical composition of the plated layer is formed of, by mass %, 50.00% or more of Zn,
more than 10.00% and less than 40.00% of Al,
more than 5.00% and less than 12.50% of Mg,
0% or more and 3.00% or less of Sn,
0% or more and 1.00% or less of Bi,
0% or more and 1.00% or less of In,
0.03% or more and 2.00% or less of Ca,
0% or more and 0.50% or less of Y,
0% or more and 0.50% or less of La,
0% or more and 0.50% or less of Ce,
0% or more and 2.50% or less of Si,
0% or more and 0.25% or less of Cr,
0% or more and 0.25% or less of Ti,
0% or more and 0.25% or less of Ni,
0% or more and 0.25% or less of Co,
0% or more and 0.25% or less of V,
0% or more and 0.25% or less of Nb,
0% or more and 0.25% or less of Cu,
0% or more and 0.25% or less of Mn,
more than 0% and 5.00% or less of Fe,
0% or more and 0.50% or less of Sr,
0% or more and 0.50% or less of Sb,
0% or more and 0.50% or less of Pb,
0% or more and 0.50% or less of B,
0% or more and 0.50% or less of Li,
0% or more and 0.50% or less of Zr,
0% or more and 0.50% or less of Mo,
0% or more and 0.50% or less of W,
0% or more and 0.50% or less of Ag,
0% or more and 0.50% or less of P,
and impurities,
the following Expression 1 and Expression 2 are satisfied, and Expression 3 and Expression 6 are further satisfied in an X-ray diffraction pattern of a surface of the plated layer measured using Cu-Kα rays under a condition that an X-ray output is 40 kV and 150 mA.

$$0 \leq Cr+Ti+Ni+Co+V+Nb+Cu+Mn \leq 0.25 \quad \text{Expression 1}$$

$$0 \leq Sr+Sb+Pb+B+Li+Zr+Mo+W+Ag+P \leq 0.50 \quad \text{Expression 2}$$

$$I(MgZn_2(41.31°))/I\Sigma(MgZn_2) \leq 0.265 \quad \text{Expression 3}$$

$$0.150 \leq \{I(MgZn_2(20.79°))+I(MgZn_2(42.24°))\}/I\Sigma(MgZn_2) \quad \text{Expression 6}$$

Here, the element symbols in Expression 1 and Expression 2 each indicate an amount (mass %) of each element in the plated layer in terms of mass %, and 0 is substituted when the element is not contained. Also, $I\Sigma(MgZn_2)$, $I(MgZn_2\ (41.31°))$, $I(MgZn_2\ (20.79°))$, and $I(MgZn_2\ (42.24°))$ in Expression 3 and Expression 6 are as follows, and $I\Sigma(Mg_2Sn)$ is 0 when the plated layer does not contain Sn.

$I\Sigma(MgZn_2)$: A sum of intensities of diffraction peaks of a (100) plane, a (002) plane, a (101) plane, a (102) plane, a (110) plane, a (103) plane, a (112) plane, a (201) plane, a (004) plane, a (203) plane, a (213) plane, a (220) plane, a (313) plane, and a (402) plane of $MgZn_2$.

$I(MgZn_2\ (41.31°))$: An intensity of the diffraction peak of the (201) plane of $MgZn_2$.

$I(MgZn_2\ (20.79°))$: An intensity of the diffraction peak of the (002) plane of $MgZn_2$.

$I(MgZn_2\ (42.24°))$: An intensity of the diffraction peak of the (004) plane of $MgZn_2$.

In the plated steel according to the present embodiment, an average composition of Sn of the plated layer may be Sn: 0.03% or more and 1.50% or less.

In the plated steel according to the present embodiment, Expression 4 and Expression 5 may be further satisfied in an X-ray diffraction image of the surface of the plated layer measured using Cu-Kα rays under a condition that an X-ray output is 40 kV and 150 mA.

$$1.0 \leq I(Al0.71Zn0.29(38.78°))/I(Al(38.47°)) \quad \text{Expression 4}$$

$$1.0 \leq I((Al0.71Zn0.29(38.78°))/I(Zn(38.99°)) \quad \text{Expression 5}$$

Here, I(Al0.71Zn0.29 (38.78°)), I(Al (38.47°)), and I(Zn (38.99°)) in Expression 4 and Expression 5 are as follows.

I(Al0.71Zn0.29 (38.78°)): An intensity of a diffraction peak of a (101) plane of Al0.71Zn0.29.

I(Al (38.47°)): An intensity of a diffraction peak of a (111) plane of Al.

I(Zn (38.99°)): An intensity of a diffraction peak of a (100) plane of Zn.

In the plated steel according to the present embodiment, the following Expression 3' may be satisfied instead of the above-described Expression 3.

$$I(MgZn_2(41.31°))/I\Sigma(MgZn_2) \leq 0.140 \quad \text{Expression 3'}$$

In the plated steel according to the present embodiment, the following Expression 6' may be satisfied instead of the above-described Expression 6.

$$0.350 \leq \{I(MgZn_2(20.79°))+I(MgZn_2(42.24°))\}/I\Sigma(MgZn_2) \quad \text{Expression 6'.}$$

Further, in the following description, "%" denoted in each element content of the chemical composition means "mass %." Also, a numerical range denoted using "to" means a range including the numerical values mentioned before and after "to" as the lower limit value and the upper limit value. Also, a numerical range in which "more than" or "less than" is attached to a numerical value written before or after "to" means a range in which the numerical value is not included as the lower limit value or the upper limit value.

Also, "corrosion resistance of the planar portion" indicates a property that the plated layer itself is resistant to corrosion. Also, "sacrificial corrosion resistance" indicates a property of suppressing corrosion of an exposed portion (a place in which a base steel (steel) is exposed, for example, at a cut end surface portion of the plated steel and a cracked portion of the plated layer during processing, and due to peeling of the plated layer) of the base steel (steel).

Steel to be plated will be described. A form of the steel is not particularly limited, and a forming-processed steel such as a steel pipe, a civil engineering and construction material (a fence conduit, a corrugated pipe, a drain cover, a sand prevention plate, a bolt, a wire mesh, a guardrail, a water stop wall, and the like), a household appliance member (a case of an outdoor unit of an air conditioner, and the like), and an automobile part (an underbody part and the like) can be exemplified as the steel in addition to a steel sheet. Various plastic deformation processing methods such as, for example, press processing, roll forming, and bending processing can be utilized for the forming processing.

There is no particular restriction on a material of the steel. Steels of various types such as, for example, ordinary steel, Ni pre-plated steel, Al-killed steel, ultralow-carbon steel, high-carbon steel, various high tensile strength steels, and some high-alloy steels (steels containing strengthening elements such as Ni and Cr) can be applied to the steel. Also, the steel is not particularly limited in conditions such as a manufacturing method of steel and a manufacturing method of a steel sheet (a hot rolling method, a pickling method, a cold rolling method, or the like). Further, the steel may be pre-plated steel that has been pre-plated.

Next, a plated layer will be described. The plated layer according to the present embodiment includes a Zn—Al—Mg based alloy layer. Also, the plated layer may include an Al—Fe alloy layer.

The Zn—Al—Mg based alloy layer is made of a Zn—Al—Mg based alloy. The Zn—Al—Mg based alloy means a ternary alloy containing Zn, Al, and Mg.

The Al—Fe alloy layer is an interfacial alloy layer between the steel and a Zn—Al—Mg alloy layer.

That is, the plated layer may have a single layer structure of a Zn—Al—Mg alloy layer, or may have a laminated structure including a Zn—Al—Mg alloy layer and an Al—Fe alloy layer. In a case of the laminated structure, the Zn—Al—Mg alloy layer is preferably a layer forming a surface of the plated layer. However, an oxide film of constituent elements of the plated layer is formed at a thickness of about 50 nm on an outermost surface of the plated layer, but the thickness is small relative to a thickness of the entire plated layer and this is regarded as not forming a main constituent of the plated layer.

A total thickness of the plated layer is 3 to 80 μm, and is preferably 5 to 70 μm. A thickness of the Al—Fe alloy layer is tens of nm to about 5 μm. The steel and the Zn—Al—Mg based alloy layer are combined by the Al—Fe alloy layer. The thickness of the Al—Fe alloy layer as an interfacial alloy layer can be arbitrarily controlled by a temperature of a plating bath during manufacture of the plated steel and an immersion time in the plating bath, and thus there is no problem in forming the Al—Fe alloy layer having such a thickness.

Further, since a thickness of the entire plated layer depends on plating conditions, upper and lower limits of the thickness of the entire plated layer are not particularly limited. For example, the thickness of the entire plated layer is related to a viscosity and a specific gravity of the plating bath in a normal hot-dip plating method. Further, a plating weight based on the basis weight is adjusted by a drawing speed of the steel sheet (plating original sheet) and a strength of wiping.

The Al—Fe alloy layer is formed on a surface (specifically, between the steel and the Zn—Al—Mg alloy layer) of the steel, and is a layer whose main phase is an $Al_5Fe$ phase as a structure thereof. The Al—Fe alloy layer is formed by mutual atomic diffusion of the base steel (steel) and the plating bath. When hot-dip plating is used as a manufacturing method, an Al—Fe alloy layer is likely to be formed in a plated layer containing elemental Al. Since Al is contained at a certain concentration or higher in the plating bath, the $Al_5Fe$ phase is formed to the greatest extent. However, atomic diffusion takes time, and there is a portion in which an Fe concentration becomes high in a portion close to the base steel. Therefore, the Al—Fe alloy layer may partially contain a small amount of an AlFe phase, an $Al_3Fe$ phase, an $Al_5Fe_2$ phase, or the like. Also, since Zn is also contained at a certain concentration in the plating bath, a small amount of Zn is also contained in the Al—Fe alloy layer.

When Si is contained in the plated layer, Si is particularly likely to be incorporated into the Al—Fe alloy layer and may become an Al—Fe—Si intermetallic compound phase. An intermetallic compound phase identified includes an AlFeSi phase, and there are α, β, q1, q2-AlFeSi phases and the like as isomers. Therefore, these AlFeSi phases or the like may be detected in the Al—Fe alloy layer. The Al—Fe alloy layer containing these AlFeSi phases or the like is also called an Al—Fe—Si alloy layer.

Next, an average chemical composition of the plated layer will be described. When the plated layer has a single-layer structure of the Zn—Al—Mg alloy layer, the average chemical composition of the entire plated layer is an average chemical composition of the Zn—Al—Mg alloy layer. Also, when the plated layer has a laminated structure of an Al—Fe alloy layer and a Zn—Al—Mg alloy layer, the average chemical composition of the entire plated layer is an average chemical composition of a total of the Al—Fe alloy layer and the Zn—Al—Mg alloy layer.

Normally, in a hot-dip plating method, a chemical composition of the Zn—Al—Mg alloy layer is almost the same as that in the plating bath because a formation reaction of the plated layer is mostly completed in the plating bath. Also, in the hot-dip plating method, the Al—Fe alloy layer is instantly formed and grown immediately after immersion in the plating bath. Then, the formation reaction of the Al—Fe alloy layer is completed in the plating bath, and a thickness thereof also is often sufficiently small compared to that of the Zn—Al—Mg alloy layer. Therefore, unless a special heat treatment such as a heat alloying treatment (at higher than 400° C.) is performed after the plating, the average chemical composition of the entire plated layer is substantially equal to the chemical composition of the Zn—Al—Mg alloy layer, and components such as the Al—Fe alloy layer can be ignored.

Hereinafter, elements contained in the plated layer will be described.

[Zn: 50.00% or more]

Zn is an element necessary for obtaining a sacrificial corrosion resistance action in a processed portion in addition to the planar portion corrosion resistance. If a Zn content is less than 50.00%, the Zn—Al—Mg alloy layer is mainly composed of an Al phase, and a Zn phase and an Al—Zn phase for securing sacrificial corrosion resistance are insufficient. Therefore, the Zn content is set to 50.00% or more. More preferably, the Zn content is set to 65.00% or more, or 70.00% or more. Further, an upper limit of the Zn content is an amount of elements other than Zn and the balance other than impurities. Although the sacrificial corrosion resistance basically improves as an Mg content in the plated layer increases, as a premise for securing the sacrificial corrosion resistance, the plating in the present invention needs to be Zn-based plating. That is, in the Zn—Al—Mg based plating, if the Al content increases and an amount of the Al phase increases in addition to the increase in the Mg content, a balance of the sacrificial corrosion resistance may be lost, and conversely, the corrosion resistance may deteriorate. It takes time for elution of the Al phase, and a difference in elution with Mg is too large, and red rust tends to generate. Therefore, in order to obtain an appropriate sacrificial corrosion resistance action, a certain amount of Zn is required to be eluted at an appropriate timing.

[Al: more than 10.00% and less than 40.00%]

Similarly to Zn, Al is an element that forms a main constituent of the plated layer. Although Al has a small effect on the sacrificial corrosion resistance action, the planar portion corrosion resistance improves when Al is contained. Also, if there is no Al, Mg cannot be stably retained in the plating bath, and thus Al is added to the plating bath as an essential element in manufacturing. If an Al content is too high, the sacrificial corrosion resistance cannot be secured, and thus the Al content is set to less than 40.00%. On the other hand, if the Al content is 10.00% or less, there is a tendency of being difficult to contain alloying elements such as Mg and Ca that impart performance to the plated layer. Also, since Al is low in density, compared to Zn, a large phase amount of Al phase is formed with respect to a content on a mass basis. However, when the Al content is 10.00% or less, most of the Zn—Al—Mg alloy layer tends to be the Zn phase. Thereby, this also leads to a significant deterioration in the planar portion corrosion resistance. In the present embodiment, it is not preferable for the Zn phase to be a first phase from the perspective of corrosion resistance. As will be described later, when the Zn phase is the first phase, a ternary eutectic structure of Zn—Al—$MgZn_2$ that is poor in planar portion corrosion resistance and processability is likely to generate, and the planar portion corrosion resistance and processability tend to deteriorate. Therefore, the Al content is set to more than 10.00% and less than 40.00%.

[Mg: more than 5.00% and less than 12.50%]

Mg is an element having a sacrificial corrosion resistance effect. When Mg is contained at a certain concentration or higher, an $MgZn_2$ phase is formed in the plated layer. The $MgZn_2$ phase is a phase that contributes to sacrificial corrosion resistance and planar portion corrosion resistance, and when a proportion of this phase is high in the plated layer, the sacrificial corrosion resistance and the planar portion corrosion resistance are improved. The sacrificial corrosion resistance due to Mg is exhibited when Mg elutes and combines with hydroxide ions ($OH^-$) formed by a reduction reaction to form a hydroxide-based film, thereby preventing elution of the steel. In order to secure a certain level of sacrificial corrosion resistance, it is necessary to contain more than 5.00% of Mg. If the Mg content is 5.00% or less, an amount of formed $MgZn_2$ phase is insufficient, and the sacrificial corrosion resistance cannot be ensured.

Here, the $MgZn_2$ phase has a structure called Laves phase, is very hard, and has poor processability. The more it is formed, the more the processability of the plated layer deteriorates, numerous cracks are generated in the processed portion or the like in a certain region, and the plated layer becomes a state of being easily peeled off. Therefore, the plated layer containing a high concentration of Mg is likely to cause powdering, corrosion resistance of the processed portion is not easily secured, and thus the Mg content is set to less than 12.50%, and preferably 10.00% or less.

[Sn: 0% or more and 3.00% or less, Bi: 0% or more and 1.00% or less, In: 0% or more and 1.00% or less]

Sn, Bi, and In are optional addition elements, and when Sn, Bi, and In are contained, Mg combines with these elements in preference to Zn and forms intermetallic compounds such as $Mg_2Sn$, $Mg_3Bi_2$, $Mg_3In$, and $Mg_5In_2$. Similarly to the $MgZn_2$ phase, these intermetallic compounds contribute more to the sacrificial corrosion resistance and the planar portion corrosion resistance. Further, since these intermetallic compounds are softer than the $MgZn_2$ phase, there is no deterioration in the processability of the plated layer due to inclusion of these compounds. When Sn is contained in an amount of 0.03% or more, and Bi and In are each contained in an amount of 0.10% or more, formation of these intermetallic compounds is observed, and therefore if Sn, Bi, and In are configured to be contained, Sn is preferably contained in an amount of 0.03% or more, and Bi and In are each preferably contained in an amount of 0.10% or more. Further, among these intermetallic compounds, in consideration of having planar portion corrosion resistance and sacrificial corrosion resistance and being easily included in the Zn phase that is soft enough to be processed and has high plastic deformability, $Mg_2Sn$ is the most excellent. Therefore, among Sn, Bi, and In, it is more preferable to contain Sn.

When one or more of Sn, Bi, and In are contained, the sacrificial corrosion resistance improves significantly. In order to prevent corrosion of a wide area with no plated film such as a cut end surface portion, corrosion resistance can be improved by containing these elements. That is, this is because $Mg_2Sn$ or the like formed by containing these elements dissolves at an early stage to form a thin protective film of Mg on the cut end surface, and thereby corrosion thereafter is greatly suppressed.

Also, when one or more of Sn, Bi, and In are contained, the planar portion corrosion resistance and especially the corrosion resistance of the cut end surface portion are improved, but excessive inclusion of these elements improves sacrificial corrosion resistance of the plated layer, and as a result, the plated layer is more likely to be eluted and this adversely affects the corrosion resistance of the planar portion or the like. Therefore, an upper limit of Sn is set to 3.00% or less, and upper limits of Bi and In are each set to 1.00% or less. Sn is more preferably set to 1.50% or less.

[Ca: 0.03% or more and 2.00% or less, Y: 0% or more and 0.50% or less, La: 0% or more and 0.50% or less, Ce: 0% or more and 0.50% or less]

Among these elements, Ca is an essential additional element, and the other elements are optional additional elements. These elements are often substituted with Mg and facilitate a crystal orientation of the $MgZn_2$ phase. When these elements are included, a sufficient crystal orientation of the $MgZn_2$ phase occurs. Particularly, Ca needs to be contained in an amount of at least 0.03% or more to cause a sufficient crystal orientation. Thereby, the corrosion resistance and the sacrificial corrosion resistance tend to improve slightly. That is, Ca, Y, La, and Ce are substituted with part of Mg in $MgZn_2$ and $Mg_2Sn$. That is, at least one of Ca, Y, La, and Ce is substituted with part of Mg in $MgZn_2$ and $Mg_2Sn$, and thereby an MgCaZn phase and an Mg(Ca, Y, La, Ce)Zn phase are formed from $MgZn_2$, and an MgCaSn phase and an Mg(Ca, Y, La, Ce)Sn phase are formed from $Mg_2Sn$. Although the exact chemical formula is not known, when mapping such as EPMA is performed for these elements, there are cases in which Sn and Mg, and these elements are detected from a position detected at the same time, and thus it is considered that Sn and Mg form an intermetallic compound at the position at which Sn and Mg are detected at the same time.

In order to obtain orientation, it is desirable that Ca be contained in an amount of 0.05% or more, Y be contained in an amount of 0.10% or more, and La and Ce be each contained in an amount of 0.10% or more.

On the other hand, an upper limit of Ca is set to 2.00%, and upper limits of Y, La, and Ce are each set to 0.50%. When amounts of Ca, Y, La, and Ce exceed the upper limits, there is a likelihood that Ca, Y, La, and Ce will each form an intermetallic compound phase composed mainly of each element, harden the plated layer, cause cracking during processing of the plated layer, and then cause powdering peeling. Preferably, Ca is set to 1.00% or less, Y is set to 0.30% or less, and La and Ce are each set to 0.30% or less.

[Si: 0% or more and 2.50% or less]

Si is an optional additional element, and since it is a small element compared to Ca, Y, La, Ce, Bi, In, and the like, Si forms an interstitial solid solution, but details thereof have not been ascertained. As an effect due to Si, it is generally known to have an effect of suppressing growth of an Al—Fe alloy layer, and an effect of improving corrosion resistance has also been ascertained. Si also forms an interstitial solid solution in the Al—Fe alloy layer. Descriptions on formation of the Al—Fe—Si intermetallic compound phase or the like in the Al—Fe alloy layer has already been described above. Therefore, when Si is configured to be contained, it is preferably contained in an amount of 0.03% or more, more preferably in an amount of 0.05% or more, and still more preferably in an amount of 0.10% or more.

On the other hand, excessive Si forms an intermetallic compound such as an $Mg_2Si$ phase or the like in the plated layer. The $Mg_2Si$ phase slightly deteriorates the planar portion corrosion resistance. Also, when at least one of Ca, Y, La, and Ce is configured to be contained, an intermetallic compound phase such as a $Ca_2Si$ phase is formed, and an effect of containing Ca, Y, and the like is reduced. Also, Si forms a strong Si-containing oxide film on a surface of the plated layer. This oxide film makes it difficult for elements to be eluted from the plated layer and deteriorates the sacrificial corrosion resistance. Particularly, the sacrificial corrosion resistance is greatly affected to be reduced at an early stage of corrosion before a barrier of the Si-containing oxide film collapses. Therefore, a Si content is set to 2.50% or less. The Si content is preferably 0.50% or less and more preferably 0.30% or less.

Si in the plated layer is an element that serves an important role in controlling an orientation of an $MgZn_2$ crystal in the present invention. When Fe is immersed in a plating bath at 400° C. or higher, Fe immediately reacts with a plated steel sheet, Fe diffuses during plating, and an interface formation reaction occurs first. Thereafter, Al solidification and $MgZn_2$ solidification occur, but if there is no Si in the plating bath and Fe diffusion is active, a crystal nucleation reaction of Al and $MgZn_2$ and the subsequent growth with the interface as a starting point may be suppressed, an orientation of the crystal is not made constant, and the subsequent control on the crystal becomes difficult. On the other hand, when Si is added, Si in the plating bath is first attracted to the steel sheet when Fe is immersed in the plating bath, and excessive Fe diffusion into the plating and crystal nucleation are suppressed. Also, a state suitable for controlling the crystal orientation of the $MgZn_2$ phase can be obtained due to formation of an Al—Fe—Si interfacial alloy layer. Therefore, in order to effectively control the crystal mainly formed of $MgZn_2$ disclosed in the present invention, the Si content is preferably set to 0.030% or more.

[Cr: 0% or more and 0.25% or less, Ti: 0% or more and 0.25% or less, Ni: 0% or more and 0.25% or less, Co: 0% or more and 0.25% or less, V: 0% or more and 0.25% or less, Nb: 0% or more and 0.25% or less, Cu: 0% or more and 0.25% or less, Mn: 0% or more and 0.25% or less]

These elements are optional additional elements, and although it is difficult to ascertain an addition effect thereof when compared to that of the above-described elements Sn, Bi, and In, they are all high-melting-point metals, and when they are dissolved in fine intermetallic compounds in the plated layer or a metal phase such as Al phase, or form a substitutional solid solution, properties of the plated layer are somewhat changed. A main action thereof is that, when a noble metal is added, a noble intermetallic compound is partially formed in the plated layer, and corrosion of the plated layer is microscopically accelerated to facilitate elution. Almost no effect can be ascertained on the planar portion corrosion resistance, but a protective film effect due to rust acts by the slight acceleration of corrosion, and thus the corrosion resistance of the cut end surface portion is improved. However, addition at an excessive concentration leads to extreme deterioration in corrosion resistance of the plated layer. Therefore, upper limits of amounts of these elements are each set to 0.25%. Also, in order to cause the above-described effects to be exhibited, these elements may be each contained in an amount of 0.01% or more.

Also, when a total amount of Cr, Ti, Ni, Co, V, Nb, Cu, and Mn exceeds 0.25%, they form intermetallic compounds with other constituent elements in the plated layer, and an effect of improving the plated layer cannot be seen. For example, an intermetallic compound containing only one elemental Mg such as $MgCu_2$ phase is formed, and the planar portion corrosion resistance and the sacrificial corrosion resistance deteriorate. Therefore, it is necessary to satisfy the following Expression 1.

$$0 \leq Cr+Ti+Ni+Co+V+Nb+Cu+Mn \leq 0.25 \quad \text{Expression 1}$$

[Fe: more than 0% and 5.00% or less]

Fe largely depends on the base steel that internally diffuses into the plated layer in the plating process when a plated steel sheet is manufactured by a hot-dip plating method or the like, and may be contained in the plated layer in an amount up to a maximum of about 5.00%, but corrosion resistance does not change greatly according to a Fe amount.

[Sr: 0% or more and 0.50% or less, Sb: 0% or more and 0.50% or less, Pb: 0% or more and 0.50% or less, B: 0% or more and 0.50% or less, Li: 0% or more and 0.50% or less, Zr: 0% or more and 0.50% or less, Mo: 0% or more and 0.50% or less, W: 0% or more and 0.50% or less, Ag: 0% or more and 0.50% or less, P: 0% or more and 0.50% or less]

These elements are optional additional elements, are elements that greatly affect an appearance of the plating, and have an effect of clarifying spangle formation and an effect of obtaining white luster. In order to obtain these effects, elements may each be contained in an amount of 0.01% or more. However, if each of these elements exceeds 0.50%, processability and corrosion resistance of the plating may deteriorate, and thus upper limits thereof are each set to 0.50%. Also, these elements tend to improve corrosion resistance of the planar portion of the plated layer. When these elements are added, an oxide film is formed on a surface of the plating and a barrier effect against corrosion factors is enhanced. Therefore, the corrosion resistance of the planar portion tends to be improved when a certain amount of these elements are contained.

Also, if a total amount of these elements exceeds 0.50%, since an effect of improving the plated layer may not be seen and the corrosion resistance of the plated layer may deteriorate, the following Expression 2 needs to be satisfied.

$$0 \leq Sr+Sb+Pb+B+Li+Zr+Mo+W+Ag+P \leq 0.50 \quad \text{Expression 2}$$

[Impurities]

Impurities are components contained in raw materials or components mixed in during manufacturing processes, and refer to components that are not intentionally contained. In hot-dip plating, presence or absence of impurities normally depends on a degree of refining of an alloy used as the plating. Regarding a concentration of the impurities, since 0.01% or 100 ppm is usually a detection limit of equipment used for component analysis, those below this may be regarded as impurities. Therefore, a concentration of intentionally added impurities normally exceeds 0.01%. For example, the plated layer may contain a very small amount of components other than Fe as impurities due to mutual atomic diffusion between the steel (base steel) and the plating bath. The impurities mean elements such as, for example, S and Cd. These impurities are preferably limited to 0.01% or less to fully exhibit effects of the present invention. Also, since an amount of impurities is preferably low, there is no need to limit a lower limit value, and the lower limit value of the impurities may be 0%.

To identify an average chemical composition of the plated layer, an acid solution is obtained by peeling and dissolving the plated layer with an acid containing an inhibitor that suppresses corrosion of the base steel (steel). As for the acid solution, a method corresponding to JIS H 1111 or JIS H 1551 is employed to prepare a solution in which the plated layer is completely dissolved without residue. Next, a chemical composition of the plated layer can be obtained by measuring the obtained acid solution by an ICP emission spectroscopy method. For measurement of a plating adhesion amount, hydrochloric acid (at a concentration of 10% (containing a surfactant)), which is an acid capable of dissolving the plated layer, is used as the acid species. The plating adhesion amount ($g/m^2$) can be obtained by measuring an area and a weight before and after peeling.

Next, Expression 3 to Expression 6, Expression 3', and Expression 6' will be described.

In the plated steel according to the present embodiment, Expression 3 to Expression 6 needs to be satisfied in an X-ray diffraction image of a surface of the plated layer measured using Cu-Kα rays under a condition that an X-ray output is 40 kV and 150 mA. Also, Expression 3' or Expression 6' may be satisfied.

Regarding constituent phases of the plated layer according to the present embodiment, since the plated layer is the Zn—Al—Mg based plating, a Zn phase, an Al phase, an $MgZn_2$ phase, and the like are phases that constitute typical plated layer in the concentration range illustrated in the present embodiment. Also, an Al—Zn phase containing Zn and Al is also included in the plated layer according to the present embodiment. Proportions of these phases each tend to increase as a concentration of the element constituting each phase increases. Also, when Sn, Bi, Si, and the like are contained, intermetallic compounds such as $Mg_2Sn$, $Mg_3Bi_2$, and $Mg_2Si$ are also contained although they are very small amounts. It has been found that the sacrificial corrosion resistance action is given to the Al phase when a large amount of Zn, which is originally precipitated as a Zn phase, is made to be contained in an a phase (primary Al phase) in a Zn—Al—Mg ternary system to form the Al—Zn phase, and the sacrificial corrosion resistance action is further enhanced and the corrosion resistance of the processed portion is further improved when a proportion of the $MgZn_2$ phase present in the plated layer is increased.

In order to improve all the corrosion resistance such as corrosion resistance and sacrificial corrosion resistance of the planar portion, and corrosion resistance of the processed portion, in addition to optimizing a component composition of the plated layer, it is necessary to optimize allocation of a phase composition ratio of the phases formed of the intermetallic compounds constituting the plated layer as much as possible. Particularly, basic performance of the plated layer, such as corrosion resistance and sacrificial corrosion resistance of the planar portion, is often determined by the component composition in general, but the corrosion resistance of the processed portion varies greatly according to a size of the constituent phases, hardness of the phases, orientations, and the like.

Here, as a method for measuring proportions of these phases, an X-ray diffraction method using Cu as a target as an X-ray source is the most convenient because it can obtain average information on the constituent phases in the plated layer. As an example of measurement conditions, X-ray conditions are set to a voltage of 40 kV and a current of 150 mA. An X-ray diffractometer is not particularly limited, but for example, a sample horizontal-type strong X-ray diffractometer RINT-TTR III manufactured by Rigaku Corporation can be used.

As the measurement conditions for the device other than the X-ray source, a goniometer TTR (horizontal goniometer) with a KO filter slit width of 0.05 mm, a longitudinal limiting slit of 2 mm, a light receiving slit of 8 mm, a light receiving slit 2 open, a scan speed of 5 deg./min, a step width of 0.01 deg., and a scan axis 20 of 5 to 90 degrees is used.

An index of the phase proportion (Expression 3 to Expression 6, Expression 3' or Expression 6') suitable for the corrosion resistance of the processed portion can be obtained by picking up diffraction peak intensities of the phases contained in the plated layer from an X-ray diffraction pattern obtained by the X-ray diffraction and obtaining proportions thereof.

In the present embodiment, in order to measure a proportion of $MgZn_2$ contained in the plated layer, among the X-ray diffraction peak intensities corresponding to the Zn phase, the Al phase, the $MgZn_2$ phase, and the Al—Zn phase, a sum of specific diffraction peak intensities is obtained. With reference to the JCPDS card, among diffraction peaks appearing in the X-ray diffraction pattern of the plated layer, clear diffraction peaks that do not overlap those of other constituent phases are selected.

For the $MgZn_2$ phase, referring to the JCPDS card (#00-034-0457), a sum of maximum intensities of diffraction peaks of a (100) plane near 19.67°, a (002) plane near 20.79°, a (101) plane near 22.26°, a (102) plane near 28.73°, a (110) plane near 34.34°, a (103) plane near 37.26°, a (112) plane near 40.47°, a (201) plane near 41.3°, a (004) plane near 42.24°, a (203) plane near 51.53°, a (213) plane near 63.4°, a (220) plane near 72.35°, a (313) plane near 84.26°, and a (402) plane near 89.580 is obtained. These are expressed as $I\Sigma(MgZn_2)$.

For the Al—Zn phase, referring to the JCPDS card (#00-019-0057) of Al0.71Zn0.29, a sum of maximum intensities of diffraction peaks of a (101) plane near 38.780 and a (003) plane near 39.86° is obtained. This is expressed as $I\Sigma$(Al—Zn).

Also, an intensity of the diffraction peak of the (201) plane of $MgZn_2$ is defined as $I(MgZn_2\ (41.31°))$, an intensity of the diffraction peak of the (002) plane of $MgZn_2$ is defined as $I(MgZn_2\ (20.79°))$, and an intensity of the diffraction peak of the (004) plane of $MgZn_2$ is defined as $I(MgZn_2\ (42.24°))$. Further, an intensity of the diffraction peak of the (101) plane of Al0.71Zn0.29 is defined as I(Al0.71Zn0.29 (38.78°)), an intensity of the diffraction peak of the (111) plane of Al is defined as I(Al (38.47°)), and an intensity of the diffraction peak of the (100) plane of Zn is defined as I(Zn (38.99°)).

Further, for the intensities of these diffraction peaks, the peak intensities obtained by measurement are used as they are, and background processing is not performed. The background intensity is included in all diffraction intensities. This is because the background intensity is smaller than a diffraction peak of the intermetallic compound to be measured in the present embodiment, and has almost no influence due to division by an intensity ratio. Also, since the diffraction peak of the above-described specific intermetallic compound has an angle that does not overlap diffraction peaks of intermetallic compounds contained in other plating, the peak intensity at each angle can be taken as a unique diffraction peak intensity from each intermetallic compound and used for a quantitative evaluation. Further, a unit of the peak intensity is cps (count per sec).

Hereinafter, Expression 3 to Expression 6, Expression 3', and Expression 6' determined by IΣ(Al0.71Zn0.29), I($MgZn_2$ (41.31°)), I($MgZn_2$ (20.79°)), and I($MgZn_2$ (42.24°)) will be described.

[Regarding Expression 3 and Expression 3']

Here, even if the phase proportion of the $MgZn_2$ phase in the plated layer is within a preferable range, the corrosion resistance of the processed portion may not be sufficient. In a processed portion formed by bending processing or the like, since an exposed range of the base steel extends if the plated layer has been cracked, high sacrificial corrosion resistance is required to reliably prevent corrosion of the processed portion. Whether or not cracks generated in the plated layer during processing extend vertically in a thickness direction of the plated layer can also change retention and formation behavior of corrosion products thereafter, and thus a direction in which cracks propagate in the plated layer may affect the corrosion resistance of the processed portion.

Therefore, as a result of investigating a relationship between a form of cracks and sacrificial corrosion resistance in the plated layer, the present inventors found that, when a diffraction peak intensity of the (201) plane of the $MgZn_2$ phase in the X-ray diffraction pattern is reduced to be small, generation of cracks of the plated layer in the processed portion can be suppressed and the corrosion resistance of the processed portion can be improved. In JCPDS #00-034-0457, the diffraction peak of the (201) plane of the $MgZn_2$ phase is regarded as a diffraction peak indicating the maximum diffraction intensity, and a diffraction angle thereof is 2θ=41.31°. Here, on the basis of the diffraction intensity of JCPDS #00-034-0457, when an orientation ratio of the (201) plane of the $MgZn_2$ phase is calculated as I($MgZn_2$(41.31°))/IΣ($MgZn_2$), the value is about 0.27. Even in a conventional plated steel, when the steel is allowed to cool naturally after plating, an orientation ratio (I($MgZn_2$ (41.31°))/IΣ($MgZn_2$)) of the (201) plane of the $MgZn_2$ phase is about 0.27. Therefore, the present inventors have found that, when the orientation ratio of the (201) plane of the $MgZn_2$ phase is adjusted to be small by adjusting manufacturing conditions of the plated layer, the number of cracks tends to decrease during T-bending of the plated layer, and this is highly effective in suppressing powdering. Therefore, in the plated steel of the present embodiment, the orientation ratio of the (201) plane of the $MgZn_2$ phase is set to 0.265 or less as shown in the following Expression 3. The orientation ratio is preferably set to 0.140 or less as shown in the following Expression 3'.

$$I(MgZn_2(41.31°))/I\Sigma(MgZn_2)\leq 0.265 \quad \text{Expression 3}$$

$$I(MgZn_2(41.31°))/I\Sigma(MgZn_2)\leq 0.140 \quad \text{Expression 3'}$$

[Regarding Expression 6 and Expression 6']

Also, in order to further improve the corrosion resistance of the processed portion, it is necessary to further optimize a plane orientation of the $MgZn_2$ phase. In order to improve plastic deformability of the plated layer with respect to bending processing to make a form of cracks of the plated layer preferable, the orientation ratio of the (002) plane and the (004) plane of the $MgZn_2$ phase is increased. When the X-rays are Cuα1 rays, the (002) plane of the $MgZn_2$ phase is 2θ=20.79°, and the (004) plane of the $MgZn_2$ phase is 2θ=42.24°. When the orientation ratio of the (002) plane and (004) plane of the $MgZn_2$ phase defined by Expression of the right-hand side of the following Expression 6 is set to 0.150 or more, the number of cracks in the plated layer during processing is reduced, and corTosion resistance of the processed portion is improved. More preferably, the orientation ratio of the (002) plane and the (004) plane of the $MgZn_2$ phase is set to 0.350 or more as shown in the following Expression 6'. That is, when the (002) plane and the (004) plane are aligned in a Z-axis direction, resistance against propagation of the cracks in the Z-axis direction is generated. Also, cracks are generated in a shape in which a crack direction thereof is inclined about 45 degrees from a direction parallel/perpendicular to the Z axis, the number of cracks reaching the base steel is reduced, lengths of the cracks increase, rust tends to remain in these cracks even after corrosion, and progressing of corrosion in the processed portion is extremely slowed down. That is, it has been found that development of corrosion can be controlled by the orientation ratio of the $MgZn_2$ phase, and even in a plated layer containing a large amount of $MgZn_2$ phase having poor processability, the number of cracks in a shape of the processed portion can be reduced (processability is improved) and corrosion resistance can be improved.

$$0.150\leq\{I(MgZn_2(20.79°))+I(MgZn_2(42.24°))\}/I\Sigma(MgZn_2) \quad \text{Expression 6}$$

$$0.350\leq\{I(MgZn_2(20.79°))+I(MgZn_2(42.24°))\}/I\Sigma(MgZn_2) \quad \text{Expression 6'.}$$

Further, $Mg_2Zn_{11}$ may also be formed in the plated layer as a constituent phase composed of Mg and Zn like $MgZn_2$. This is a substance that easily precipitates as an original equilibrium phase of the Zn—Al—Mg based plating. Although the $Mg_2Zn_{11}$ phase is formed by a specific heat treatment, but when the phase is formed, corrosion resistance deteriorates, properties of the $MgZn_2$ phase obtained by the crystal orientation are lost, and processed portion corrosion resistance deteriorates, and therefore formation of the phase is preferably suppressed through the process.

[Regarding Expression 4 and Expression 5]

Also, as a method for improving corrosion resistance of the processed portion, it can also be achieved by converting the Al phase, which is originally difficult to elute, into a phase having a sacrificial corrosion resistance effect such as Zn. The Al0.79Zn0.21 phase is a phase having a sacrificial corrosion resistance action that is intermediate between the Al phase and the Zn phase. These phases are phases formed in a form in which the Zn phase, which should have been originally separated from the Al phase, is incorporated into the Al phase by rapid cooling of plating solidification. Proportions of these phases present can also be compared by an intensity ratio of diffraction peak intensities of the X-ray diffraction pattern. When an amount of the Al0.79Zn0.21 phase is more than that of the Al phase and the Zn phase by a certain amount, the corrosion resistance of the processed portion is improved. When compared to the $MgZn_2$ phase, the Al0.79Zn0.21 phase is a relatively soft phase and is considered to act favorably on a form of the cracks of the plated layer. Specifically, a higher intensity ratio of a plane orientation of a (101) plane (2θ=38.78°) of the Al0.79Zn0.21 phase to plane orientations of a (111) plane (2θ=38.47°) of the Al phase and a (100) plane (2θ=38.99°) of the Zn phase is considered to act more favorably on the form of cracks of the plated layer. That is, it is preferable to satisfy the following Expression 4 and Expression 5. Thereby, the sacrificial corrosion resistance and cracks of the plated layer during processing are in a desirable state, and the processed portion corrosion resistance is improved.

$$1.00\leq I(Al0.71Zn0.29(38.78°))/I(Al(38.47°)) \quad \text{Expression 4}$$

$$1.00\leq I((Al0.71Zn0.29(38.78°))/I(Zn(38.99°)) \quad \text{Expression 5}$$

Further, it is possible to obtain the Al0.71Zn0.29 phase by rapidly cooling a specific temperature range without a crystal orientation of the $MgZn_2$ phase, but in this case, it is difficult to ascertain improvement in corrosion resistance of a bending processed portion. That is, even if sacrificial corrosion resistance is improved by containing the Al0.71Zn0.29 phase, since it is not possible to overcome a degree of deterioration of the processed portion in a state in which there are a large number of cracks, the effect appears only after the crystal orientation of the $MgZn_2$ phase is controlled. Also, Al0.71Zn0.29 is formed when a temperature is retained within a specific temperature range, but needs to be formed by separating the Zn phase from the Al phase containing the Zn phase in a state of oversaturation. Therefore, the formation needs to be performed by rapid cooling during plating solidification and then retaining the specific temperature. When an amount thereof is large, the effect of the processed portion corrosion resistance also increases.

Next, a manufacturing method of the plated steel of the present embodiment will be described.

The plated steel of the present embodiment includes a steel and a plated layer formed on a surface of the steel. The Zn—Al—Mg based plating is normally formed by metal deposition and a solidification reaction. The easiest method for forming the plated layer is to form a plated layer on a surface of a steel sheet by a hot-dip plating method, and the plated layer can also be formed by a Zenzimer method, a flux method, or the like. Also, a vapor deposition plating method or a method of forming a plated film by thermal spraying may be applied to the plated steel of the present embodiment, and can obtain the same effects as those in the case of forming the plated layer by the hot-dip plating method.

Hereinafter, a case in which the plated steel of the present embodiment is manufactured by a hot-dip plating method will be described. The plated steel of the present embodiment can be manufactured by either an immersion plating method (batch type) or a continuous plating method.

There are no particular restrictions on a size, a shape, a surface form, and the like of the steel to be plated. Ordinary steel, stainless steel, and the like are applicable as long as they are steel. A steel strip of general structural steel is most preferable. Surface finishing such as shot blasting may be performed in advance, and there is no problem even if a metal film of 3 $g/m^2$ or less such as Ni, Fe, or Zn plating or an alloy film thereof is adhered to the surface and then the plating is performed. Also, as a pretreatment of the steel, it is preferable to sufficiently wash the steel by degreasing and pickling.

After a surface of a steel sheet is sufficiently heated and reduced by a reducing gas such as $H_2$, the steel is immersed in a plating bath prepared with predetermined components.

In a case of the hot-dip plating method, components of the plated layer can be controlled by components of a plating bath to be prepared. Preparation of the plating bath involves preparing an alloy of plating bath components by mixing a predetermined amount of a pure metal by, for example, a dissolution method under an inert atmosphere.

When the steel whose surface has been reduced is immersed in the plating bath maintained at a predetermined concentration, a plated layer having substantially the same components as those of the plating bath is formed. If the immersion time is extended or if it takes a long time to complete solidification, a Fe concentration may increase because formation of the interfacial alloy layer becomes active, but since a reaction with the plated layer rapidly slows down at 500° C. or lower, the concentration of Fe contained in the plated layer usually falls to less than 5.00%.

It is preferable to immerse the reduced steel in a plating bath at 500° C. to 650° C. for several seconds to form a hot-dip plated layer. On a surface of the reduced steel, Fe diffuses into the plating bath and reacts with the plating bath, and an interfacial alloy layer (mainly an Al—Fe based intermetallic compound layer) is formed at an interface between the plated layer and the steel sheet. Due to the interfacial alloy layer, the steel on a lower side of the interfacial alloy layer and the plated layer on an upper side thereof metal-chemically combine.

After the steel is immersed in the plating bath for a predetermined time, the steel is pulled up from the plating bath, $N_2$ wiping is performed while the metal adhered to the surface is in a molten state, and thereby the plated layer is adjusted to a predetermined thickness. The thickness of the plated layer is preferably adjusted to 3 to 80 μm. When this is converted to an adhesion amount of the plated layer, it is 10 to 500 $g/m^2$ (one side). Also, the thickness of the plated layer may be adjusted to 5 to 70 μm. When this is converted to an adhesion amount, it is 20 to 400 $g/m^2$ (one side).

After the adhesion amount of the plated layer is prepared, the adhered molten metal is solidified. A cooling method during solidification of the plating may be performed by spraying nitrogen, air, or a mixed gas of hydrogen and helium, mist cooling, or immersion in water. Mist cooling is preferable, and mist cooling in which water is contained in nitrogen is preferable. A cooling rate may be adjusted according to a content ratio of water.

As for an average cooling rate when the plated layer is solidified, cooling in a range of 500° C. to 250° C. is performed under the condition of an average cooling rate of 10° C./second or faster. With the composition of the present invention, Expression 3 is satisfied under the condition of this average cooling rate. More preferably, cooling in the range of 500° C. to 250° C. is performed under the condition of an average cooling rate of 50° C./second or faster. An upper limit of the average cooling rate does not need to be particularly set, but may be, for example, 100° C./second or slower from the perspective of controlling the cooling rate. The average cooling rate is obtained by dividing a temperature difference between a temperature at the start of cooling and a temperature at the end of cooling by a time from the start of cooling to the end of cooling.

When the average cooling rate in the range of 500° C. to 250° C. is controlled as described above, orientations of (002) and (004) planes can be increased, and an orientation of an (201) plane, which tends to precipitate conventionally, can be reduced.

Also, increasing the cooling rate is also effective for formation of the Al0.71Zn0.29 phase. Particularly, when the cooling rate from 250° C. to 150° C. is controlled, it is possible to increase a phase amount of the Al0.71Zn0.29 phase. For example, cooling in the range of 250° C. to 150° C. is performed under the condition of an average cooling rate of 10° C./second or faster. The Al phase can contain a large amount of Zn phase inside at a high temperature. When the cooling rate is slow and an equilibrium state is near, the Zn phase is separated from the Al phase in the plated layer, and the two phases are completely separated. On the other hand, if the cooling rate is fast, separation does not easily occur, and part of Zn remains in the Al phase. Thereby, Al0.71Zn0.29 is easily formed. Further, if the cooling rate during this period is not increased, the formation of Al0.71Zn0.29 may decrease even if the subsequent heat treatment is performed appropriately.

In the component composition of the plated layer of the present embodiment, both the orientation of the $MgZn_2$ phase and phase transformation (formation of Al0.71Zn0.29) of the plated layer are completed in a temperature range of 500° C. to 150° C. If transformation behavior of the plating alloy itself is ascertained by a differential thermal analysis or the like, since a transformation point does not appear at 150° C. or lower and there is no transformation behavior due to heat at this temperature or lower, a cooling rate to 150° C. may be defined in the temperature range at the time of manufacturing. A temperature range for controlling the average cooling rate from just below a melting point is set to 500 to 150° C.

Further, when the temperature is 500° C. or lower, a large amount of $MgZn_2$ phase normally precipitates, and the cooling rate at this time affects the orientation of the $MgZn_2$ phase and the phase transformation of the plated layer. Therefore, regardless of the melting point, the temperature of the plating bath is set to 500° C. or higher. If the plating melting point is lower than 500° C., the solidification reaction does not occur at immediately below 500° C., but the orientation is affected by a gradient of the cooling rate in the initial solidification. Since a cooling rate with a large gradient, that is at immediately below 500° C., determines the orientation, the bath temperature is set to 500° C. or higher regardless of the melting point of the plating bath.

Also, in a temperature range higher than 500° C., if a high cooling rate by such as immersion in water or mist cooling is applied, since heat removal from the surface increases, crystal nuclei are generated infinitely, and an effect of the orientation of the $MgZn_2$ phase cannot be sufficiently obtained, this solidification method cannot be used. Therefore, a temperature range from a temperature immediately after the steel is pulled up out of the plating bath to 500° C. is preferably set as a slow cooling section, and the cooling rate is preferably set to, for example, 10° C./second or slower.

When the cooling rate is made to increase at the time point at which the plating bath adhered to the steel sheet reaches 500° C., the orientation of the $MgZn_2$ phase is completed. It may be cooled to around room temperature at a high cooling rate. There is no problem even if it is cooled to 150° C. or lower. However, if the cooling rate is fast, phases that should have normally been separated cannot be separated according to an extent to which the orientation of the $MgZn_2$ phase is large, and a strain may be accumulated in the plated layer due to aging. When the plated layer is left in such a state for a long period of time immediately after cooling, cracks may generate in the oriented $MgZn_2$ phase after elapse of some time, and the strain in the plated layer is released.

However, when the heat treatment is performed, a phase in which the above-described (002) and (004) planes are oriented can be formed, and processability as a plated steel sheet is improved. That is, it is important to perform a heat treatment that incorporates the (002) and (004) planes into a preferential orientation by applying a preferential crystal orientation, and further reducing the (201) plane orientation of the $MgZn_2$ phase that is a plane orientation facing another direction.

Also for the Al0.79Zn0.21 phase, a large amount of oversaturated Al phase containing more Zn phase than this ratio is formed, and a phase that is not favorable for the planar portion corrosion resistance and the processed portion corrosion resistance of the plating is formed. Therefore, it is necessary to perform a heat treatment that reheats to a temperature at which the Al0.79Zn0.21 phase is easily formed. Further, the Al0.79Zn0.21 phase cannot be sufficiently obtained unless rapid cooling is performed before the reheating.

When the reheating is performed, orientation of the $MgZn_2$ phase and precipitation of the Al0.79Zn0.21 phase can be promoted, and performance such as processability, and the planar portion corrosion resistance and the processed portion corrosion resistance of the plating can be improved. Further, it may be cooled at a high cooling rate from near 500° C. to 250° C. and then the temperature may be retained as it is, but since it is difficult to make the retention temperature constant in a short period of time from cooling at the high cooling rate in terms of the process, the reheating process is easier to perform. In such a cooling and retention process, the orientation of the $MgZn_2$ phase may not be sufficient, the plated layer may tend to crack, and an amount of formed Al0.79Zn0.21 phase may decrease.

Here, the reheating means that the temperature of the plated layer is lowered to lower than 150° C. by the above-described cooling and then heating is performed so that the temperature normally rises by 20° C. or higher from the temperature. The reheating is preferably performed at a temperature of 170 to 300° C. for 3 seconds or longer and 60 seconds or shorter, and this is simple and easy to set as the heat treatment condition.

Further, depending on how the composition is selected, there are compositions that facilitate orientation of the $MgZn_2$ phase and compositions that facilitate formation of the Al0.79Zn0.21 phase, but in the initial stage of plating solidification, it is important to set a fast cooling rate in the range of 500 to 150° C. and reheat at an appropriate temperature and retention time.

When the reheating condition satisfies the following Expression A, orientation of the (002) plane and (004) plane of the $MgZn_2$ phase is likely to occur. If the reheating condition deviates from a lower limit of Expression A, the crystal orientation will be insufficient. If the reheating condition deviates from an upper limit of Expression A, a large amount of Mg2Zn11 will be formed and greatly impair properties of the plated layer.

$$66000 \leq [\text{Mg concentration}] \times [\text{Mg concentration}] \times [\text{Retention time}] \times [\text{Retention temperature}] \leq 500000 \quad \text{Expression A}$$

More preferably, when the following Expression A' is satisfied, the orientation proceeds and Expression 6 tends to become more preferable.

$$150000 \leq [\text{Mg concentration}] \times [\text{Mg concentration}] \times [\text{Retention time}] \times [\text{Retention temperature}] \leq 400000 \quad \text{Expression A'}$$

Also, when the following Expression B is satisfied, formation of the Al0.79Zn0.21 phase is promoted.

$$440000 \leq [\text{Al concentration}] \times [\text{Al concentration}] \times [\text{Retention time}] \times [\text{Retention temperature}] \leq 6000000 \quad \text{Expression B}$$

Further, whether crystal orientations of the $MgZn_2$ phase and the $Mg_2Zn_{11}$ phase are defective can also be determined from X-ray diffraction peaks. For example, in the diffraction peaks of the plated layer according to the present invention, both are small in amount when the $Mg_2Zn_{11}$ phase precipitated in the plated layer is compared to the $MgZn_2$ phase, when a value obtained by dividing a peak ($2\theta=19.6°$) intensity of the $MgZn_2$ phase by a peak ($2\theta=14.6°$) intensity of the $Mg_2Zn_{11}$ phase is defined as an X-ray diffraction peak intensity ratio of $MgZn_2/Mg_2Zn_{11}$, it indicates 5 or more.

After the plating, various chemical conversion treatments and coating treatments may be performed. A plated layer such as Cr, Ni, Au, or the like can be further provided utilizing an uneven pattern on a surface of the plating, and furthermore, coating can be provided to give a design. Also, in order to further enhance corrosion resistance, touch-up paint for repair, thermal spraying, or the like may be applied to welded portions, processed portions, and the like.

In the plated steel of the present embodiment, a film may be formed on the plated layer. One or more layers of the film can be formed. As types of film immediately above the plated layer, for example, a chromate film, a phosphate film, and a chromate-free film can be mentioned. A chromate treatment, a phosphate treatment, and a chromate-free treatment for forming these films can be performed by known methods.

The chromate treatment includes an electrolytic chromate treatment in which a chromate film is formed by electrolysis, a reactive-type chromate treatment in which a film is formed by utilizing a reaction with the material and then a surplus treatment liquid is washed away, and a coating-type chromate treatment in which a treatment liquid is applied to an object to be coated and dried without being washed away to form a film. Any of the treatments may be employed.

As the electrolytic chromate treatment, electrolytic chromate treatments using chromic acid, a silica sol, a resin (phosphoric acid, an acrylic resin, a vinyl ester resin, a vinyl acetate acrylic emulsion, a carboxylated styrene-butadiene latex, a diisopropanolamine-modified epoxy resin, or the like), and hard silica can be exemplified.

As the phosphate treatment, for example, a zinc phosphate treatment, a zinc calcium phosphate treatment, and a manganese phosphate treatment can be mentioned.

The chromate-free treatment is suitable particularly because it does not burden the environment. The chromate-free treatment includes an electrolytic-type chromate-free treatment in which a chromate-free film is formed by electrolysis, a reactive-type chromate-free treatment in which a film is formed by utilizing a reaction with the material and then a surplus treatment liquid is washed away, and a coating-type chromate-free treatment in which a treatment liquid is applied to an object to be coated and dried without being washed away to form a film. Any of the treatments may be employed.

Furthermore, one or more layers of an organic resin film may be provided on a film immediately above the plated layer. The organic resin is not limited to a specific type, and examples thereof include a polyester resin, a polyurethane resin, an epoxy resin, an acrylic resin, a polyolefin resin, modified products of these resins, and the like. Here, the modified product refers to a resin obtained by reacting a reactive functional group contained in a structure of each of these resins with another compound (a monomer, a cross-linker, or the like) containing a functional group capable of reacting with the above-described functional group in a structure thereof.

As such an organic resin, one or more types of organic resins (that are not modified) may be mixed and used, or one or more types of organic resins, which are obtained by modifying at least one type of organic resins in the presence of at least one type of other organic resins, may be mixed and used. Also, any of color pigments or rust-preventive pigments may be contained in the organic resin film. A water-based product obtained by dissolving or dispersing in water can also be used.

For the corrosion resistance of the planar portion of the plated layer, a corrosion resistance of a bare planar portion may be evaluated by an exposure test, a salt water spray test (JIS Z2371), a combined cycle corrosion test (CCT) including a salt water spray test, or the like. Also, in order to ascertain the sacrificial corrosion resistance, superiority and inferiority in sacrificial corrosion resistance can be evaluated by performing any of the above-described tests with the plated steel sheet open at a cut end surface and evaluating a red rust area ratio (smaller one in size is superior in corrosion resistance) of the end surface portion.

Also, a cross-cut portion may be prepared on a surface of the plated layer to evaluate development of corrosion from the cross-cut portion. In a plated steel with high sacrificial corrosion resistance, eluted ions ($Zn^{2+}$, $Mg^{2+}$) from the plated layer flow into the cross-cut portion, where corrosion products are formed to stop the development of corrosion, and a width of white rust around the cut portion tends to be reduced. If the sacrificial corrosion resistance is low, since corrosion of the plated layer over a wide range is accompanied to stop the development of corrosion at the cut portion, a width of the corrosion around the cut portion tends to increase.

For the processed portion corrosion resistance, after the plated steel sheet is bent at a predetermined angle using a press machine, a bender, and the like, the plated steel sheet as is processed may be subjected to an exposure test or various accelerated corrosion tests. In a processed portion of an alloy plated layer, since a plated layer cannot follow processing (elongation) of the steel sheet, the plated layer is broken and exposed portions (cracks) of the base steel are generated in places. In cracks, sacrificial corrosion resistance that is approximate to that of the cross-cut portion acts, but since an area of the cracks is normally larger than that of the cross-cut portion and furthermore follows ductility and properties of the plated layer, various factors such as a peel-off portion and the like act, and it becomes a place in which corrosion develops easily. Corrosion is more easily developed around the crack portion than in the planar portion, red rust may be generated at an early stage, and thus it is possible to evaluate the corrosion resistance of the processed portion of the plated steel by measuring a period until the red rust is generated.

According to the plated steel of the present embodiment, when a crystal orientation of the $MgZn_2$ phase in the plated layer is controlled, crack propagation in a thickness direction of the plated layer can be reduced, and thereby it is possible to provide a plated steel that can suppress corrosion from the processed portion even if the bending processed portion of the steel is placed in a severe corrosive environment.

Also, the corrosion resistance of the processed portion of the plated layer can be effectively improved by controlling a state of presence of the $MgZn_2$ phase in the plated layer. Also, the corrosion resistance can be further improved by reducing the Zn phase and increasing the Al—Zn phase in the plated layer.

EXAMPLE

Plated steels relating to Table 1a to Table 5c were manufactured and performance evaluations were performed.

For formulation of plating baths of various types, pure metals (purity of 4N or higher) were formulated to prepare the baths. As for components of a plating alloy, Fe powder was added after the bath is prepared so that an Fe concentration did not increase during the test. As for components of a plated steel sheet, a plated layer was peeled off with hydrochloric acid in which IBIT manufactured by Asahi Chemical Industry Co., Ltd. was dissolved as an inhibitor, and an adhesion amount was measured. As for components of the plated layer, a component analysis of the peeled-off components was performed using an ICP emission spectrophotometer manufactured by Shimadzu Corporation.

Hot-rolled original sheets (3.2 mm) of 180×100 size were used as original sheets of the plated steel, and a batch-type hot-dip plating simulator (manufactured by RHESCA Co., Ltd.) was used. All of them are SS400 (general steel). A K thermocouple was attached to a part of each of the plated steel sheets and annealed at 800° C. in an $N_2$ (H2-5% reduction) atmosphere to sufficiently reduce a surface of the plating original sheet, the plated steel sheet was iimmersed in the plating bath for 3 seconds and then pulled up, and a plating thickness was made to be 25 to 30 μm by $N_2$ gas wiping. After the plated steel sheets were pulled up, plated steels were manufactured under various cooling conditions and reheating conditions described in Table 1a to Table 1c. Further, "-" in the table means that reheating was not performed. Also, the underlined one indicates that it is outside the scope of the present invention.

The plated steel after plating was cut into 20 mm square, a high-angle X-ray diffractometer manufactured by Rigaku Corporation (model number RINT-TTR III) with a goniometer TTR (horizontal goniometer), a Kβ filter slit width of 0.05 mm, a longitudinal limiting slit width of 2 mm, a light receiving slit width of 8 mm, and a light receiving slit 2 open was used, and measurement was performed with a scan speed of 5 deg./min, a step width of 0.01 deg., and a scan axis of 2θ (5 to 90°) as measurement conditions to obtain a cps intensity at each angle. An X-ray source was Cu-Kα rays using Cu as a target, and an X-ray output was set at a voltage of 40 kV and a current of 150 mA.

(Corrosion Resistance of Planar Portion)

As an index for evaluating corrosion resistance of the planar portion, the plating steel sheet was cut into 100×50 mm sizes and these were subjected to 60 cycles of corrosion tests in a combined cycle corrosion test (JASO M609-91). Corrosion weight loss after 90 cycles was evaluated, and superiority or inferiority was determined according to criteria of S, AAA, AA, A, and B according to the following levels. Further, S, AAA, AA, and A were regarded as passing.

S: Corrosion weight loss is less than 50 g/m$^2$

AAA: Corrosion weight loss is 50 g/m$^2$ or more and 60 g/m$^2$ or less

AA: Corrosion weight loss is 60 g/m$^2$ or more and 70 g/m$^2$ or less

A: Corrosion weight loss is more than 70 g/m$^2$ and 80 g/m$^2$ or less

B: Corrosion weight loss is more than 80 g/m$^2$ (Sacrificial Corrosion Resistance)

In order to evaluate sacrificial corrosion resistance, three pieces of cut end surfaces of samples with a 100×50 mm size were coated with an epoxy-based resin for waterproof treatment. An open end surface was defined as one end surface, and burr directions were unified. Each of these samples was subjected to the same JASO test as described above, and a red rust area ratio after 90 cycles of JASO was evaluated. A photograph was taken from an end surface direction, and superiority or inferiority was determined according to criteria of S, AAA, A, and B according to the following levels for a cross section (approximately 3.2 mm×100 mm) thereof. S, AAA, and A were regarded as passing.

S: Red rust area ratio is less than 30%

AAA: Red rust area ratio is 30% or more and less than 50%

A: Red rust area ratio is 50% or more and less than 70%

B: Red rust area ratio is 70% or more (Corrosion Resistance of Bent Portion)

The plated steel sheet was bent at 1800 using a bender, then an inner surface was crushed to a thickness of one sheet by a hand press, and thereby a 1T bending test piece (t=3.2) was prepared. A coating treatment was performed around the bent portion to completely repair a base steel exposed portion. With a T-bending top portion facing upward, the test piece was put into the combined cycle corrosion test (JASO M609-91). A period until the red rust area ratio of the top portion reached 5% was evaluated. Evaluation criteria were as follows. 8, AAA, AA, and A were regarded as passing.

S: more than 135 cycles

AAA: more than 105 cycles and 135 cycles or less

AA: more than 75 cycles and 105 cycles or less

A: 60 cycles or more and 75 cycles or less

B: less than 60 cycles

TABLE 1a

| | | Cooling rate (° C./sec) | | | | |
|---|---|---|---|---|---|---|
| | | Bath | | | Reheating condition | |
| No. | Remarks | temperature to 500° C. | 500 to 250° C. | 250 to 150° C. | Temperature (° C.) | Time (sec) |
| 1 | Comparative example | 7.5 | 75 | 75 | 260 | 39 |
| 2 | Comparative example | 9 | 90 | 90 | 230 | 52 |
| 3 | Comparative example | 5.5 | 55 | 55 | 210 | 29 |
| 4 | Example | 6 | 60 | 60 | 200 | 35 |
| 5 | Example | 8.5 | 60 | 65 | 185 | 44 |
| 6 | Example | 7.5 | 75 | 75 | 300 | 30 |
| 7 | Example | 7.5 | 20 | 7.5 | 200 | 45 |
| 8 | Example | 7.5 | 75 | 20 | 250 | 12 |
| 9 | Example | 7.5 | 75 | 20 | 200 | 30 |
| 10 | Example | 7.5 | 20 | 20 | 180 | 10 |
| 11 | Example | 8 | 25 | 15 | 170 | 50 |
| 12 | Comparative example | 9 | 9 | 25 | 220 | 40 |
| 13 | Comparative example | 18 | 18 | 18 | 240 | 35 |
| 14 | Example | 9.5 | 21 | 9 | 250 | 25 |
| 15 | Comparative example | 8 | 80 | 65 | — | — |
| 16 | Comparative example | 6 | 65 | 60 | 280 | 54 |
| 17 | Example | 5.5 | 55 | 90 | 300 | 10 |
| 18 | Example | 6 | 80 | 80 | 200 | 20 |
| 19 | Comparative example | 125 | 95 | 55 | 250 | 40 |
| 20 | Comparative example | 9 | 9 | 8 | 300 | 30 |

TABLE 1a-continued

| No. | Remarks | Cooling rate (° C./sec) Bath temperature to 500° C. | 500 to 250° C. | 250 to 150° C. | Reheating condition Temperature (° C.) | Time (sec) |
|---|---|---|---|---|---|---|
| 21 | Example | 8 | 80 | 80 | 250 | 12 |
| 22 | Example | 8 | 90 | 90 | 200 | 40 |
| 23 | Comparative example | 8 | 90 | 90 | 250 | 32 |
| 24 | Example | 5.5 | 55 | 25 | 250 | 40 |
| 25 | Comparative example | 7.5 | 95 | 15 | 250 | 24 |
| 26 | Comparative example | 9.5 | 95 | 15 | 300 | 30 |
| 27 | Comparative example | 9.5 | 55 | 25 | 300 | 50 |
| 28 | Example | 8 | 90 | 90 | 200 | 40 |
| 29 | Example | 6 | 70 | 70 | 180 | 40 |
| 30 | Example | 8 | 90 | 90 | 200 | 30 |
| 31 | Comparative example | 6 | 70 | 70 | 280 | 28 |
| 32 | Example | 8 | 90 | 90 | 300 | 12 |
| 33 | Comparative example | 9 | 70 | 70 | 250 | 28 |
| 34 | Example | 5.5 | 80 | 80 | 230 | 24 |
| 35 | Comparative example | 8 | 90 | 90 | 220 | 21 |
| 36 | Example | 8.5 | 80 | 65 | 210 | 20 |
| 37 | Comparative example | 8 | 90 | 90 | 200 | 20 |

TABLE 1b

| No. | Remarks | Cooling rate (° C./sec) Bath temperature to 500° C. | 500 to 250° C. | 250 to 150° C. | Reheating condition Temperature (° C.) | Time (sec) |
|---|---|---|---|---|---|---|
| 38 | Example | 6.5 | 60 | 60 | 190 | 20 |
| 39 | Comparative example | 8 | 90 | 90 | 180 | 20 |
| 40 | Example | 7 | 70 | 70 | 170 | 20 |
| 41 | Comparative example | 8 | 90 | 90 | 260 | 20 |
| 42 | Comparative example | 7 | 75 | 75 | 270 | 20 |
| 43 | Example | 7 | 90 | 65 | 280 | 20 |
| 44 | Example | 7.5 | 55 | 25 | 200 | 10 |
| 45 | Example | 7.5 | 75 | 20 | 300 | 30 |
| 46 | Example | 5.5 | 25 | 25 | 300 | 30 |
| 47 | Comparative example | 5.5 | 5.5 | 15 | 300 | 30 |
| 48 | Comparative example | 25 | 25 | 25 | 300 | 30 |
| 49 | Example | 9.5 | 25 | 9.5 | 300 | 30 |
| 50 | Comparative example | 9.5 | 95 | 95 | — | — |
| 51 | Comparative example | 9.5 | 95 | 95 | 250 | 52 |
| 52 | Example | 9.5 | 95 | 95 | 300 | 10 |
| 53 | Example | 8.5 | 80 | 65 | 300 | 30 |
| 54 | Comparative example | 175 | 95 | 95 | 300 | 30 |
| 55 | Comparative example | 9.5 | 9.5 | 9.5 | 300 | 30 |
| 56 | Example | 7.5 | 75 | 75 | 250 | 8 |
| 57 | Example | 5.5 | 55 | 25 | 240 | 10 |
| 58 | Example | 7 | 70 | 70 | 250 | 30 |
| 59 | Comparative example | 8.5 | 80 | 65 | 250 | 30 |
| 60 | Example | 9 | 75 | 75 | 250 | 30 |
| 61 | Example | 7 | 55 | 75 | 250 | 30 |
| 62 | Comparative example | 8.5 | 80 | 65 | 250 | 30 |
| 63 | Example | 6 | 90 | 70 | 250 | 30 |
| 64 | Comparative example | 8.5 | 80 | 65 | 250 | 30 |
| 65 | Comparative example | 8.5 | 80 | 65 | 250 | 30 |
| 66 | Comparative example | 9.5 | 90 | 70 | 250 | 30 |
| 67 | Comparative example | 7.5 | 75 | 20 | 250 | 30 |
| 68 | Example | 7.5 | 75 | 20 | 250 | 30 |
| 69 | Comparative example | 7.5 | 75 | 20 | 250 | 30 |
| 70 | Comparative example | 7.5 | 75 | 20 | 250 | 30 |
| 71 | Comparative example | 7.5 | 75 | 20 | 250 | 30 |
| 72 | Example | 7 | 90 | 90 | 300 | 30 |
| 73 | Example | 9.5 | 25 | 9.5 | 200 | 30 |
| 74 | Example | 9.5 | 55 | 55 | 200 | 25 |

TABLE 1c

| No. | Remarks | Cooling rate (° C./sec) Bath temperature to 500° C. | 500 to 250° C. | 250 to 150° C. | Reheating condition Temperature (° C.) | Time (sec) |
|---|---|---|---|---|---|---|
| 75 | Example | 5.5 | 25 | 15 | 250 | 30 |
| 76 | Example | 7.5 | 75 | 20 | 200 | 30 |
| 77 | Example | 5.5 | 95 | 15 | 200 | 7.5 |
| 78 | Example | 7.5 | 75 | 20 | 200 | 25 |
| 79 | Example | 9.5 | 95 | 15 | 200 | 25 |
| 80 | Comparative example | 9.5 | 9.5 | 25 | 200 | 25 |
| 81 | Comparative example | 15 | 15 | 15 | 200 | 25 |
| 82 | Example | 5.5 | 15 | 5.5 | 200 | 25 |
| 83 | Comparative example | 5.5 | 55 | 55 | 200 | 25 |
| 84 | Comparative example | 5.5 | 55 | 55 | 200 | 25 |
| 85 | Example | 5.5 | 55 | 55 | 270 | 15 |
| 86 | Example | 7 | 55 | 55 | 200 | 25 |
| 87 | Comparative example | 125 | 55 | 55 | 200 | 25 |
| 88 | Comparative example | 5.5 | 5.5 | 5.5 | 200 | 25 |
| 89 | Example | 7.5 | 70 | 75 | 200 | 5 |
| 90 | Comparative example | 8.5 | 80 | 65 | 200 | 5 |
| 91 | Comparative example | 9 | 75 | 75 | 200 | 5 |
| 92 | Comparative example | 7 | 55 | 75 | 200 | 20 |
| 93 | Example | 8.5 | 80 | 65 | 200 | 20 |
| 94 | Comparative example | 6 | 90 | 70 | 250 | 20 |
| 95 | Example | 8.5 | 80 | 65 | 250 | 20 |
| 96 | Comparative example | 8.5 | 80 | 65 | 250 | 20 |
| 97 | Comparative example | 7.5 | 70 | 70 | 250 | 20 |
| 98 | Example | 8.5 | 80 | 90 | 250 | 20 |
| 99 | Example | 5.5 | 75 | 75 | 200 | 10 |
| 100 | Comparative example | 5.5 | 75 | 75 | 200 | 10 |
| 101 | Comparative example | 5.5 | 75 | 75 | 200 | 10 |
| 102 | Example | 7.5 | 75 | 20 | 300 | 10 |
| 103 | Comparative example | 6 | 65 | 65 | — | — |
| 104 | Comparative example | 6 | 65 | 65 | 250 | 3 |
| 105 | Example | 7.5 | 55 | 55 | 250 | 20 |
| 106 | Example | 6 | 60 | 60 | 250 | 8 |
| 107 | Comparative example | 8.5 | 80 | 65 | 300 | 15 |
| 108 | Example | 9 | 75 | 75 | 200 | 20 |
| 109 | Comparative example | 7 | 55 | 75 | 200 | 20 |
| 110 | Comparative example | 8.5 | 80 | 65 | 200 | 20 |
| 111 | Comparative example | 6 | 90 | 70 | 200 | 20 |

TABLE 2a

| No. | Remarks | Components Zn | Al | Mg | Sn | Bi | In |
|---|---|---|---|---|---|---|---|
| 1 | Comparative example | 84.30 | 9.50 | 5.20 | 0.00 | 0.00 | 0.00 |
| 2 | Comparative example | 83.90 | 10.30 | 4.90 | 0.00 | 0.00 | 0.00 |
| 3 | Comparative example | 79.90 | 13.00 | 6.50 | 0.00 | 0.00 | 0.00 |
| 4 | Example | 79.90 | 13.00 | 6.50 | 0.00 | 0.00 | 0.00 |
| 5 | Example | 79.85 | 13.00 | 6.50 | 0.00 | 0.00 | 0.00 |
| 6 | Example | 78.60 | 14.00 | 6.00 | 0.50 | 0.00 | 0.00 |
| 7 | Example | 78.70 | 14.00 | 5.90 | 0.10 | 0.00 | 0.00 |
| 8 | Example | 77.30 | 15.00 | 6.30 | 0.20 | 0.00 | 0.00 |
| 9 | Example | 77.30 | 15.00 | 6.30 | 0.20 | 0.00 | 0.00 |
| 10 | Example | 77.30 | 15.00 | 6.30 | 0.20 | 0.00 | 0.00 |
| 11 | Example | 77.30 | 15.00 | 6.30 | 0.20 | 0.00 | 0.00 |
| 12 | Comparative example | 77.30 | 15.00 | 6.30 | 0.20 | 0.00 | 0.00 |
| 13 | Comparative example | 77.30 | 15.00 | 6.30 | 0.20 | 0.00 | 0.00 |
| 14 | Example | 77.30 | 15.00 | 6.30 | 0.20 | 0.00 | 0.00 |
| 15 | Comparative example | 77.30 | 15.00 | 6.30 | 0.20 | 0.00 | 0.00 |
| 16 | Comparative example | 77.30 | 15.00 | 6.30 | 0.20 | 0.00 | 0.00 |
| 17 | Example | 77.30 | 15.00 | 6.30 | 0.20 | 0.00 | 0.00 |
| 18 | Example | 77.30 | 15.00 | 6.30 | 0.20 | 0.00 | 0.00 |
| 19 | Comparative example | 77.30 | 15.00 | 6.30 | 0.20 | 0.00 | 0.00 |
| 20 | Comparative example | 77.30 | 15.00 | 6.30 | 0.20 | 0.00 | 0.00 |
| 21 | Example | 77.95 | 15.00 | 6.00 | 0.00 | 0.00 | 0.00 |
| 22 | Example | 75.25 | 16.00 | 7.00 | 0.40 | 0.00 | 0.00 |
| 23 | Comparative example | 75.15 | 16.00 | 7.00 | 0.40 | 0.00 | 0.00 |
| 24 | Example | 74.50 | 17.00 | 5.10 | 2.90 | 0.00 | 0.00 |
| 25 | Comparative example | 74.30 | 17.00 | 5.10 | 3.10 | 0.00 | 0.00 |
| 26 | Comparative example | 74.50 | 17.00 | 5.10 | 0.90 | 1.10 | 0.90 |

TABLE 2a-continued

| No. | Remarks | Components Zn | Al | Mg | Sn | Bi | In |
|---|---|---|---|---|---|---|---|
| 27 | Comparative example | 74.50 | 17.00 | 5.10 | 0.90 | 0.90 | 1.10 |
| 28 | Example | 75.25 | 17.00 | 7.00 | 0.00 | 0.00 | 0.00 |
| 29 | Example | 75.30 | 17.00 | 7.00 | 0.00 | 0.00 | 0.00 |
| 30 | Example | 74.80 | 17.00 | 7.00 | 0.00 | 0.00 | 0.00 |
| 31 | Comparative example | 74.70 | 17.00 | 7.00 | 0.00 | 0.00 | 0.00 |
| 32 | Example | 74.80 | 17.00 | 7.00 | 0.00 | 0.00 | 0.00 |
| 33 | Comparative example | 74.70 | 17.00 | 7.00 | 0.00 | 0.00 | 0.00 |
| 34 | Example | 74.80 | 17.00 | 7.00 | 0.00 | 0.00 | 0.00 |
| 35 | Comparative example | 74.70 | 17.00 | 7.00 | 0.00 | 0.00 | 0.00 |
| 36 | Example | 74.80 | 17.00 | 7.00 | 0.00 | 0.00 | 0.00 |
| 37 | Comparative example | 74.70 | 17.00 | 7.00 | 0.00 | 0.00 | 0.00 |

TABLE 2b

| No. | Remarks | Components Zn | Al | Mg | Sn | Bi | In |
|---|---|---|---|---|---|---|---|
| 38 | Example | 74.80 | 17.00 | 7.00 | 0.00 | 0.00 | 0.00 |
| 39 | Comparative example | 74.70 | 17.00 | 7.00 | 0.00 | 0.00 | 0.00 |
| 40 | Example | 74.80 | 17.00 | 7.00 | 0.00 | 0.00 | 0.00 |
| 41 | Comparative example | 74.70 | 17.00 | 7.00 | 0.00 | 0.00 | 0.00 |
| 42 | Comparative example | 73.70 | 17.00 | 7.00 | 0.00 | 0.00 | 0.00 |
| 43 | Example | 74.07 | 19.00 | 5.80 | 0.10 | 0.00 | 0.00 |

TABLE 2b-continued

| No. | Remarks | Components | | | | | |
|---|---|---|---|---|---|---|---|
| | | Zn | Al | Mg | Sn | Bi | In |
| 44 | Example | 73.55 | 19.00 | 6.50 | 0.05 | 0.00 | 0.00 |
| 45 | Example | 73.55 | 19.00 | 6.50 | 0.05 | 0.00 | 0.00 |
| 46 | Example | 73.55 | 19.00 | 6.50 | 0.05 | 0.00 | 0.00 |
| 47 | Comparative example | 73.55 | 19.00 | 6.50 | 0.05 | 0.00 | 0.00 |
| 48 | Comparative example | 73.55 | 19.00 | 6.50 | 0.05 | 0.00 | 0.00 |
| 49 | Example | 73.55 | 19.00 | 6.50 | 0.05 | 0.00 | 0.00 |
| 50 | Comparative example | 73.55 | 19.00 | 6.50 | 0.05 | 0.00 | 0.00 |
| 51 | Comparative example | 73.55 | 19.00 | 6.50 | 0.05 | 0.00 | 0.00 |
| 52 | Example | 73.55 | 19.00 | 6.50 | 0.05 | 0.00 | 0.00 |
| 53 | Example | 73.55 | 19.00 | 6.50 | 0.05 | 0.00 | 0.00 |
| 54 | Comparative example | 73.55 | 19.00 | 6.50 | 0.05 | 0.00 | 0.00 |
| 55 | Comparative example | 73.55 | 19.00 | 6.50 | 0.05 | 0.00 | 0.00 |
| 56 | Example | 72.60 | 19.00 | 7.00 | 0.30 | 0.00 | 0.00 |
| 57 | Example | 72.60 | 20.00 | 5.50 | 0.00 | 0.00 | 0.00 |
| 58 | Example | 70.90 | 20.00 | 7.30 | 0.50 | 0.00 | 0.00 |
| 59 | Comparative example | 70.65 | 20.00 | 7.30 | 0.50 | 0.00 | 0.00 |

TABLE 2b-continued

| No. | Remarks | Components | | | | | |
|---|---|---|---|---|---|---|---|
| | | Zn | Al | Mg | Sn | Bi | In |
| 60 | Example | 70.25 | 20.00 | 7.30 | 0.90 | 0.00 | 0.00 |
| 61 | Example | 69.85 | 20.00 | 7.30 | 0.90 | 0.00 | 0.00 |
| 62 | Comparative example | 69.75 | 20.00 | 7.30 | 0.90 | 0.00 | 0.00 |
| 63 | Example | 70.85 | 20.00 | 7.30 | 0.10 | 0.00 | 0.00 |
| 64 | Comparative example | 70.84 | 20.00 | 7.30 | 0.10 | 0.00 | 0.00 |
| 65 | Comparative example | 70.85 | 20.00 | 7.30 | 0.10 | 0.00 | 0.00 |
| 66 | Comparative example | 70.84 | 20.00 | 7.30 | 0.10 | 0.00 | 0.00 |
| 67 | Comparative example | 70.84 | 21.00 | 5.50 | 1.00 | 0.00 | 0.00 |
| 68 | Example | 70.86 | 21.00 | 5.50 | 1.00 | 0.00 | 0.00 |
| 69 | Comparative example | 70.67 | 21.00 | 5.50 | 1.00 | 0.00 | 0.00 |
| 70 | Comparative example | 70.95 | 21.00 | 5.50 | 1.00 | 0.00 | 0.00 |
| 71 | Comparative example | 71.15 | 21.00 | 5.50 | 1.00 | 0.00 | 0.00 |
| 72 | Example | 70.07 | 21.00 | 6.00 | 1.50 | 0.00 | 0.00 |
| 73 | Example | 68.60 | 22.00 | 7.50 | 0.10 | 0.00 | 0.00 |
| 74 | Example | 65.90 | 23.00 | 8.30 | 1.20 | 0.00 | 0.00 |

TABLE 2c

| No. | Remarks | Components | | | | | |
|---|---|---|---|---|---|---|---|
| | | Zn | Al | Mg | Sn | Bi | In |
| 75 | Example | 66.30 | 25.00 | 6.80 | 0.00 | 0.00 | 0.90 |
| 76 | Example | 64.40 | 25.00 | 8.10 | 0.00 | 0.90 | 0.00 |
| 77 | Example | 64.00 | 26.00 | 8.50 | 0.20 | 0.00 | 0.00 |
| 78 | Example | 64.00 | 26.00 | 8.50 | 0.20 | 0.00 | 0.00 |
| 79 | Example | 64.00 | 26.00 | 8.50 | 0.20 | 0.00 | 0.00 |
| 80 | Comparative example | 64.00 | 26.00 | 8.50 | 0.20 | 0.00 | 0.00 |
| 81 | Comparative example | 64.00 | 26.00 | 8.50 | 0.20 | 0.00 | 0.00 |
| 82 | Example | 64.00 | 26.00 | 8.50 | 0.20 | 0.00 | 0.00 |
| 83 | Comparative example | 64.00 | 26.00 | 8.50 | 0.20 | 0.00 | 0.00 |
| 84 | Comparative example | 64.00 | 26.00 | 8.50 | 0.20 | 0.00 | 0.00 |
| 85 | Example | 64.00 | 26.00 | 8.50 | 0.20 | 0.00 | 0.00 |
| 86 | Example | 64.00 | 26.00 | 8.50 | 0.20 | 0.00 | 0.00 |
| 87 | Comparative example | 64.00 | 26.00 | 8.50 | 0.20 | 0.00 | 0.00 |
| 88 | Comparative example | 64.00 | 26.00 | 8.50 | 0.20 | 0.00 | 0.00 |
| 89 | Example | 57.95 | 27.00 | 12.40 | 0.00 | 0.00 | 0.00 |
| 90 | Comparative example | 59.00 | 27.00 | 12.50 | 0.00 | 0.00 | 0.00 |
| 91 | Comparative example | 57.75 | 27.00 | 12.40 | 0.00 | 0.00 | 0.00 |
| 92 | Comparative example | 60.84 | 28.00 | 9.00 | 0.20 | 0.10 | 0.10 |
| 93 | Example | 60.86 | 28.00 | 9.00 | 0.20 | 0.10 | 0.10 |
| 94 | Comparative example | 61.74 | 29.00 | 5.50 | 0.00 | 0.00 | 0.00 |
| 95 | Example | 61.71 | 29.00 | 5.50 | 0.00 | 0.00 | 0.00 |
| 96 | Comparative example | 61.95 | 29.00 | 5.50 | 0.00 | 0.00 | 0.00 |
| 97 | Comparative example | 59.57 | 30.00 | 8.40 | 0.03 | 0.00 | 0.00 |
| 98 | Example | 59.73 | 30.00 | 8.40 | 0.03 | 0.00 | 0.00 |
| 99 | Example | 52.73 | 31.90 | 9.40 | 0.00 | 0.00 | 0.00 |
| 100 | Comparative example | 52.66 | 31.90 | 9.40 | 0.00 | 0.00 | 0.00 |
| 101 | Comparative example | 52.30 | 31.90 | 9.40 | 0.00 | 0.00 | 0.00 |
| 102 | Example | 56.70 | 35.00 | 5.80 | 0.20 | 0.00 | 0.00 |
| 103 | Comparative example | 56.70 | 35.00 | 5.80 | 0.20 | 0.00 | 0.00 |
| 104 | Comparative example | 56.70 | 35.00 | 5.80 | 0.20 | 0.00 | 0.00 |
| 105 | Example | 56.70 | 35.00 | 5.80 | 0.20 | 0.00 | 0.00 |
| 106 | Example | 56.65 | 35.00 | 5.80 | 0.20 | 0.00 | 0.00 |
| 107 | Comparative example | 56.55 | 35.00 | 5.80 | 0.20 | 0.00 | 0.00 |
| 108 | Example | 50.26 | 39.00 | 7.00 | 0.00 | 0.00 | 0.00 |
| 109 | Comparative example | 50.24 | 39.00 | 7.00 | 0.00 | 0.00 | 0.00 |
| 110 | Comparative example | 48.17 | 39.00 | 7.00 | 0.00 | 0.00 | 0.00 |
| 111 | Comparative example | 48.70 | 40.40 | 7.00 | 0.20 | 0.00 | 0.00 |

TABLE 3a

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 1 | Comparative example | 0.10 | 0.00 | 0.00 | 0.20 | 0.20 | 0.00 | 0.00 | 0.00 | 0.00 | 0.00 | 0.00 | 0.00 | 0.00 | 0.00 |
| 2 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |

TABLE 3a-continued

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 3 | Comparative example | 0.00 | 0.00 | 0.00 | 0.00 | 0.10 | 0.00 | 0.00 | 0.00 | 0.00 | 0.00 | 0.00 | 0.00 | 0.00 | 0.00 |
| 4 | Example | 0.10 | 0.00 | 0.00 | 0.00 | 0.00 | 0.00 | 0.00 | 0.00 | 0.00 | 0.00 | 0.00 | 0.00 | 0.00 | 0.00 |
| 5 | Example | 0.05 | 0.00 | 0.00 | 0.00 | 0.05 | 0.00 | 0.00 | 0.05 | 0.00 | 0.00 | 0.00 | 0.00 | 0.00 | 0.05 |
| 6 | Example | 0.05 | 0.00 | 0.00 | 0.00 | 0.30 | 0.00 | 0.00 | 0.15 | 0.00 | 0.00 | 0.00 | 0.00 | 0.00 | 0.15 |
| 7 | Example | 0.10 | 0.00 | 0.40 | 0.40 | 0.10 | 0.00 | 0.00 | 0.00 | 0.00 | 0.00 | 0.00 | 0.00 | 0.00 | 0.00 |
| 8 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 9 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 10 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 11 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 12 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 13 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 14 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 15 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 16 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 17 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 18 | Example | 0.30 | 0.00 | 0.00 | 0.00 | 0.50 | 0.00 | 0.00 | 0.00 | 0.00 | 0.00 | 0.00 | 0.00 | 0.00 | 0.00 |
| 19 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 20 | Comparative example | 0.30 | 0.00 | 0.00 | 0.00 | 0.50 | 0.00 | 0.00 | 0.00 | 0.00 | 0.00 | 0.00 | 0.00 | 0.00 | 0.00 |
| 21 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 22 | Example | 0.10 | 0.00 | 0.00 | 0.00 | 0.10 | 0.00 | 0.00 | 0.10 | 0.00 | 0.00 | 0.00 | 0.00 | 0.00 | 0.10 |
| 23 | Comparative example | 0.10 | 0.00 | 0.00 | 0.00 | 0.10 | 0.00 | 0.00 | 0.10 | 0.00 | 0.00 | 0.00 | 0.00 | 0.00 | 0.10 |
| 24 | Example | 0.10 | 0.00 | 0.00 | 0.00 | 0.10 | 0.00 | 0.00 | 0.00 | 0.00 | 0.00 | 0.00 | 0.00 | 0.00 | 0.00 |
| 25 | Comparative example | 0.10 | 0.00 | 0.00 | 0.00 | 0.10 | 0.00 | 0.00 | 0.00 | 0.00 | 0.00 | 0.00 | 0.00 | 0.00 | 0.00 |
| 26 | Comparative example | 0.10 | 0.00 | 0.00 | 0.00 | 0.10 | 0.00 | 0.00 | 0.00 | 0.00 | 0.00 | 0.00 | 0.00 | 0.00 | 0.00 |
| 27 | Comparative example | 0.10 | 0.00 | 0.00 | 0.00 | 0.10 | 0.00 | 0.00 | 0.00 | 0.00 | 0.00 | 0.00 | 0.00 | 0.00 | 0.00 |
| 28 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 29 | Example | 0.20 | 0.00 | 0.00 | 0.00 | 0.00 | 0.00 | 0.00 | 0.00 | 0.00 | 0.00 | 0.00 | 0.00 | 0.00 | 0.00 |
| 30 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 31 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 32 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 33 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 34 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 35 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 36 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 37 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |

TABLE 3b

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 38 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 39 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 40 | Example | 0.20 | 0.00 | 0.00 | 0.00 | 0.05 | 0.00 | 0.00 | 0.00 | 0.00 | 0.00 | 0.00 | 0.00 | 0.00 | 0.00 |
| 41 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 42 | Comparative example | 0.20 | 0.00 | 0.00 | 0.00 | 0.05 | 0.00 | 0.00 | 0.00 | 0.00 | 0.00 | 0.00 | 0.00 | 0.00 | 0.00 |
| 43 | Example | 0.10 | 0.00 | 0.00 | 0.00 | 0.20 | 0.00 | 0.00 | 0.13 | 0.00 | 0.00 | 0.00 | 0.00 | 0.00 | 0.13 |
| 44 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 45 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 46 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 47 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |
| 48 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |

TABLE 3b-continued

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 49 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 50 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |
| 51 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |
| 52 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 53 | Example | 0.10 | 0.00 | 0.00 | 0.00 | 0.20 | 0.00 | 0.00 | 0.00 | 0.00 | 0.00 | 0.00 | 0.00 | 0.00 | 0.00 |
| 54 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |
| 55 | Comparative example | 0.10 | 0.00 | 0.00 | 0.00 | 0.20 | 0.00 | 0.00 | 0.00 | 0.00 | 0.00 | 0.00 | 0.00 | 0.00 | 0.00 |
| 56 | Example | 0.20 | 0.00 | 0.10 | 0.10 | 0.30 | 0.00 | 0.00 | 0.00 | 0.00 | 0.00 | 0.00 | 0.00 | 0.00 | 0.00 |
| 57 | Example | 0.90 | 0.00 | 0.00 | 0.00 | 0.50 | 0.00 | 0.00 | 0.00 | 0.00 | 0.00 | 0.00 | 0.00 | 0.00 | 0.00 |
| 58 | Example | 0.10 | 0.00 | 0.00 | 0.00 | 0.60 | 0.00 | 0.00 | 0.10 | 0.00 | 0.00 | 0.00 | 0.00 | 0.00 | 0.10 |
| 59 | Comparative example | 0.10 | 0.00 | 0.00 | 0.00 | 0.60 | 0.00 | 0.00 | 0.10 | 0.15 | 0.10 | 0.00 | 0.00 | 0.00 | 0.35 |
| 60 | Example | 0.40 | 0.00 | 0.00 | 0.00 | 0.00 | 0.00 | 0.00 | 0.00 | 0.00 | 0.00 | 0.00 | 0.00 | 0.00 | 0.00 |
| 61 | Example | 0.40 | 0.00 | 0.00 | 0.00 | 0.40 | 0.00 | 0.00 | 0.00 | 0.00 | 0.00 | 0.00 | 0.00 | 0.00 | 0.00 |
| 62 | Comparative example | 0.40 | 0.00 | 0.00 | 0.00 | 0.40 | 0.00 | 0.00 | 0.00 | 0.00 | 0.00 | 0.00 | 0.00 | 0.00 | 0.00 |
| 63 | Example | 0.40 | 0.00 | 0.00 | 0.00 | 0.40 | 0.25 | 0.00 | 0.00 | 0.00 | 0.00 | 0.00 | 0.00 | 0.00 | 0.25 |
| 64 | Comparative example | 0.40 | 0.00 | 0.00 | 0.00 | 0.40 | 0.26 | 0.00 | 0.00 | 0.00 | 0.00 | 0.00 | 0.00 | 0.00 | 0.26 |
| 65 | Comparative example | 0.40 | 0.00 | 0.00 | 0.00 | 0.40 | 0.00 | 0.25 | 0.00 | 0.00 | 0.00 | 0.00 | 0.00 | 0.00 | 0.25 |
| 66 | Comparative example | 0.40 | 0.00 | 0.00 | 0.00 | 0.40 | 0.00 | 0.26 | 0.00 | 0.00 | 0.00 | 0.00 | 0.00 | 0.00 | 0.26 |
| 67 | Comparative example | 0.30 | 0.00 | 0.20 | 0.10 | 0.20 | 0.00 | 0.00 | 0.26 | 0.00 | 0.00 | 0.00 | 0.00 | 0.00 | 0.26 |
| 68 | Example | 0.30 | 0.00 | 0.20 | 0.10 | 0.20 | 0.00 | 0.00 | 0.24 | 0.00 | 0.00 | 0.00 | 0.00 | 0.00 | 0.24 |
| 69 | Comparative example | 0.30 | 0.55 | 0.00 | 0.00 | 0.20 | 0.00 | 0.00 | 0.18 | 0.00 | 0.00 | 0.00 | 0.00 | 0.00 | 0.18 |
| 70 | Comparative example | 0.30 | 0.00 | 0.55 | 0.00 | 0.20 | 0.00 | 0.00 | 0.00 | 0.00 | 0.00 | 0.00 | 0.00 | 0.00 | 0.00 |
| 71 | Comparative example | 0.00 | 0.00 | 0.00 | 0.55 | 0.20 | 0.00 | 0.00 | 0.00 | 0.00 | 0.00 | 0.00 | 0.00 | 0.00 | 0.00 |
| 72 | Example | 0.50 | 0.00 | 0.00 | 0.00 | 0.20 | 0.00 | 0.00 | 0.23 | 0.00 | 0.00 | 0.00 | 0.00 | 0.00 | 0.23 |
| 7.3 | Example | 0.30 | 0.10 | 0.10 | 0.00 | 0.40 | 0.00 | 0.00 | 0.00 | 0.00 | 0.00 | 0.00 | 0.00 | 0.00 | 0.00 |
| 74 | Example | 0.60 | 0.00 | 0.00 | 0.00 | 0.20 | 0.00 | 0.00 | 0.00 | 0.00 | 0.00 | 0.00 | 0.00 | 0.00 | 0.00 |

TABLE 3c

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 75 | Example | 0.20 | 0.00 | 0.00 | 0.00 | 0.10 | 0.00 | 0.00 | 0.00 | 0.00 | 0.00 | 0.00 | 0.00 | 0.00 | 0.00 |
| 76 | Example | 0.20 | 0.00 | 0.30 | 0.00 | 0.20 | 0.00 | 0.00 | 0.00 | 0.00 | 0.00 | 0.00 | 0.00 | 0.00 | 0.00 |
| 77 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 78 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 79 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 80 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 81 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 82 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 83 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 84 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 85 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 86 | Example | 0.20 | 0.00 | 0.00 | 0.00 | 0.20 | 0.00 | 0.00 | 0.00 | 0.00 | 0.00 | 0.00 | 0.00 | 0.00 | 0.00 |
| 87 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 88 | Comparative example | 0.20 | 0.00 | 0.00 | 0.00 | 0.20 | 0.00 | 0.00 | 0.00 | 0.00 | 0.00 | 0.00 | 0.00 | 0.00 | 0.00 |
| 89 | Example | 1.90 | 0.00 | 0.00 | 0.00 | 0.05 | 0.00 | 0.00 | 0.00 | 0.00 | 0.00 | 0.00 | 0.00 | 0.00 | 0.00 |
| 90 | Comparative example | 0.10 | 0.00 | 0.00 | 0.00 | 0.50 | 0.00 | 0.00 | 0.20 | 0.00 | 0.00 | 0.00 | 0.00 | 0.00 | 0.20 |
| 91 | Comparative example | 2.10 | 0.00 | 0.00 | 0.00 | 0.05 | 0.00 | 0.00 | 0.00 | 0.00 | 0.00 | 0.00 | 0.00 | 0.00 | 0.00 |
| 92 | Comparative example | 0.50 | 0.00 | 0.00 | 0.00 | 0.20 | 0.00 | 0.00 | 0.00 | 0.00 | 0.26 | 0.00 | 0.00 | 0.00 | 0.26 |

TABLE 3c-continued

| No. | Remarks | Components | | | | | | | | | | | | | |
|---|---|---|---|---|---|---|---|---|---|---|---|---|---|---|---|
| | | Ca | Y | La | Ce | Si | Cr | Ti | Ni | Co | V | Nb | Cu | Mn | Expression 1 |
| 93 | Example | 0.50 | 0.00 | 0.00 | 0.00 | 0.20 | 0.00 | 0.00 | 0.00 | 0.00 | 0.24 | 0.00 | 0.00 | 0.00 | 0.24 |
| 94 | Comparative example | 0.10 | 0.00 | 0.00 | 0.00 | 2.40 | 0.00 | 0.00 | 0.00 | 0.26 | 0.00 | 0.00 | 0.00 | 0.00 | 0.26 |
| 95 | Example | 0.10 | 0.00 | 0.00 | 0.00 | 2.45 | 0.00 | 0.00 | 0.00 | 0.24 | 0.00 | 0.00 | 0.00 | 0.00 | 0.24 |
| 96 | Comparative example | 0.10 | 0.00 | 0.00 | 0.00 | 2.55 | 0.00 | 0.00 | 0.00 | 0.00 | 0.00 | 0.00 | 0.00 | 0.00 | 0.00 |
| 97 | Comparative example | 0.40 | 0.00 | 0.00 | 0.00 | 0.20 | 0.00 | 0.00 | 0.14 | 0.00 | 0.00 | 0.00 | 0.26 | 0.00 | 0.40 |
| 98 | Example | 0.40 | 0.00 | 0.00 | 0.00 | 0.20 | 0.00 | 0.00 | 0.00 | 0.00 | 0.00 | 0.00 | 0.24 | 0.00 | 0.24 |
| 99 | Example | 0.70 | 0.00 | 0.00 | 0.00 | 0.05 | 0.00 | 0.00 | 0.00 | 0.00 | 0.00 | 0.00 | 0.00 | 0.23 | 0.23 |
| 100 | Comparative example | 0.70 | 0.00 | 0.00 | 0.00 | 0.05 | 0.00 | 0.00 | 0.00 | 0.00 | 0.00 | 0.00 | 0.00 | 0.24 | 0.24 |
| 101 | Comparative example | 0.70 | 0.00 | 0.00 | 0.00 | 0.05 | 0.00 | 0.00 | 0.00 | 0.00 | 0.00 | 0.00 | 0.00 | 0.26 | 0.26 |
| 102 | Example | 0.20 | 0.00 | 0.00 | 0.00 | 0.50 | 0.00 | 0.00 | 0.00 | 0.00 | 0.00 | 0.00 | 0.00 | 0.00 | 0.00 |
| 103 | Comparative example | 0.20 | 0.00 | 0.00 | 0.00 | 0.50 | 0.00 | 0.00 | 0.00 | 0.00 | 0.00 | 0.00 | 0.00 | 0.00 | 0.00 |
| 104 | Comparative example | 0.20 | 0.00 | 0.00 | 0.00 | 0.50 | 0.00 | 0.00 | 0.00 | 0.00 | 0.00 | 0.00 | 0.00 | 0.00 | 0.00 |
| 105 | Example | 0.20 | 0.00 | 0.00 | 0.00 | 0.50 | 0.00 | 0.00 | 0.00 | 0.00 | 0.00 | 0.00 | 0.00 | 0.00 | 0.00 |
| 106 | Example | 0.20 | 0.00 | 0.00 | 0.00 | 0.50 | 0.00 | 0.00 | 0.00 | 0.00 | 0.00 | 0.00 | 0.00 | 0.00 | 0.00 |
| 107 | Comparative example | 0.20 | 0.00 | 0.00 | 0.00 | 0.50 | 0.00 | 0.00 | 0.00 | 0.00 | 0.00 | 0.00 | 0.00 | 0.00 | 0.00 |
| 108 | Example | 0.30 | 0.00 | 0.00 | 0.00 | 0.20 | 0.00 | 0.00 | 0.00 | 0.00 | 0.00 | 0.24 | 0.00 | 0.00 | 0.24 |
| 109 | Comparative example | 0.30 | 0.00 | 0.00 | 0.00 | 0.20 | 0.00 | 0.00 | 0.00 | 0.00 | 0.00 | 0.26 | 0.00 | 0.00 | 0.26 |
| 110 | Comparative example | 0.30 | 0.00 | 0.00 | 0.00 | 0.20 | 0.00 | 0.00 | 0.00 | 0.00 | 0.00 | 0.23 | 0.00 | 0.00 | 0.23 |
| 111 | Comparative example | 0.20 | 0.00 | 0.00 | 0.00 | 1.60 | 0.00 | 0.00 | 0.00 | 0.00 | 0.00 | 0.00 | 0.00 | 0.00 | 0.00 |

TABLE 4a

| No. | Remarks | Components | | | | | | | | | | | |
|---|---|---|---|---|---|---|---|---|---|---|---|---|---|
| | | Fe | Sr | Sb | Pb | B | Li | Zr | Mo | W | Ag | P | Expression 2 |
| 1 | Comparative example | 0.50 | 0.00 | 0.00 | 0.00 | 0.00 | 0.00 | 0.00 | 0.00 | 0.00 | 0.00 | 0.00 | 0.00 |
| 2 | Comparative example | 0.60 | 0.00 | 0.00 | 0.00 | 0.00 | 0.00 | 0.00 | 0.00 | 0.00 | 0.00 | 0.00 | 0.00 |
| 3 | Comparative example | 0.50 | 0.00 | 0.00 | 0.00 | 0.00 | 0.00 | 0.00 | 0.00 | 0.00 | 0.00 | 0.00 | 0.00 |
| 4 | Example | 0.50 | 0.00 | 0.00 | 0.00 | 0.00 | 0.00 | 0.00 | 0.00 | 0.00 | 0.00 | 0.00 | 0.00 |
| 5 | Example | 0.50 | 0.00 | 0.00 | 0.00 | 0.00 | 0.00 | 0.00 | 0.00 | 0.00 | 0.00 | 0.00 | 0.00 |
| 6 | Example | 0.40 | 0.00 | 0.00 | 0.00 | 0.00 | 0.00 | 0.00 | 0.00 | 0.00 | 0.00 | 0.00 | 0.00 |
| 7 | Example | 0.30 | 0.00 | 0.00 | 0.00 | 0.00 | 0.00 | 0.00 | 0.00 | 0.00 | 0.00 | 0.00 | 0.00 |
| 8 | Example | 0.40 | 0.00 | 0.00 | 0.00 | 0.00 | 0.00 | 0.00 | 0.00 | 0.00 | 0.00 | 0.00 | 0.00 |
| 9 | Example | 0.40 | 0.00 | 0.00 | 0.00 | 0.00 | 0.00 | 0.00 | 0.00 | 0.00 | 0.00 | 0.00 | 0.00 |
| 10 | Example | 0.40 | 0.00 | 0.00 | 0.00 | 0.00 | 0.00 | 0.00 | 0.00 | 0.00 | 0.00 | 0.00 | 0.00 |
| 11 | Example | 0.40 | 0.00 | 0.00 | 0.00 | 0.00 | 0.00 | 0.00 | 0.00 | 0.00 | 0.00 | 0.00 | 0.00 |
| 12 | Comparative example | 0.40 | 0.00 | 0.00 | 0.00 | 0.00 | 0.00 | 0.00 | 0.00 | 0.00 | 0.00 | 0.00 | 0.00 |
| 13 | Comparative example | 0.40 | 0.00 | 0.00 | 0.00 | 0.00 | 0.00 | 0.00 | 0.00 | 0.00 | 0.00 | 0.00 | 0.00 |
| 14 | Example | 0.40 | 0.00 | 0.00 | 0.00 | 0.00 | 0.00 | 0.00 | 0.00 | 0.00 | 0.00 | 0.00 | 0.00 |
| 15 | Comparative example | 0.40 | 0.00 | 0.00 | 0.00 | 0.00 | 0.00 | 0.00 | 0.00 | 0.00 | 0.00 | 0.00 | 0.00 |
| 16 | Comparative example | 0.40 | 0.00 | 0.00 | 0.00 | 0.00 | 0.00 | 0.00 | 0.00 | 0.00 | 0.00 | 0.00 | 0.00 |
| 17 | Example | 0.40 | 0.00 | 0.00 | 0.00 | 0.00 | 0.00 | 0.00 | 0.00 | 0.00 | 0.00 | 0.00 | 0.00 |
| 18 | Example | 0.40 | 0.00 | 0.00 | 0.00 | 0.00 | 0.00 | 0.00 | 0.00 | 0.00 | 0.00 | 0.00 | 0.00 |
| 19 | Comparative example | 0.40 | 0.00 | 0.00 | 0.00 | 0.00 | 0.00 | 0.00 | 0.00 | 0.00 | 0.00 | 0.00 | 0.00 |
| 20 | Comparative example | 0.40 | 0.00 | 0.00 | 0.00 | 0.00 | 0.00 | 0.00 | 0.00 | 0.00 | 0.00 | 0.00 | 0.00 |
| 21 | Example | 0.80 | 0.00 | 0.00 | 0.00 | 0.00 | 0.00 | 0.00 | 0.00 | 0.00 | 0.00 | 0.00 | 0.00 |
| 22 | Example | 0.60 | 0.00 | 0.00 | 0.45 | 0.00 | 0.00 | 0.00 | 0.00 | 0.00 | 0.00 | 0.00 | 0.45 |
| 23 | Comparative example | 0.60 | 0.00 | 0.00 | 0.55 | 0.00 | 0.00 | 0.00 | 0.00 | 0.00 | 0.00 | 0.00 | 0.55 |
| 24 | Example | 0.30 | 0.00 | 0.00 | 0.00 | 0.00 | 0.00 | 0.00 | 0.00 | 0.00 | 0.00 | 0.00 | 0.00 |
| 25 | Comparative example | 0.30 | 0.00 | 0.00 | 0.00 | 0.00 | 0.00 | 0.00 | 0.00 | 0.00 | 0.00 | 0.00 | 0.00 |

TABLE 4a-continued

| No. | Remarks | Components | | | | | | | | | | | |
|---|---|---|---|---|---|---|---|---|---|---|---|---|---|
| | | Fe | Sr | Sb | Pb | B | Li | Zr | Mo | W | Ag | P | Expression 2 |
| 26 | Comparative example | 0.30 | 0.00 | 0.00 | 0.00 | 0.00 | 0.00 | 0.00 | 0.00 | 0.00 | 0.00 | 0.00 | 0.00 |
| 27 | Comparative example | 0.30 | 0.00 | 0.00 | 0.00 | 0.00 | 0.00 | 0.00 | 0.00 | 0.00 | 0.00 | 0.00 | 0.00 |
| 28 | Example | 0.50 | 0.00 | 0.00 | 0.00 | 0.00 | 0.00 | 0.00 | 0.00 | 0.00 | 0.00 | 0.00 | 0.00 |
| 29 | Example | 0.50 | 0.00 | 0.00 | 0.00 | 0.00 | 0.00 | 0.00 | 0.00 | 0.00 | 0.00 | 0.00 | 0.00 |
| 30 | Example | 0.50 | 0.00 | 0.00 | 0.00 | 0.00 | 0.45 | 0.00 | 0.00 | 0.00 | 0.00 | 0.00 | 0.45 |
| 31 | Comparative example | 0.50 | 0.00 | 0.00 | 0.00 | 0.00 | 0.55 | 0.00 | 0.00 | 0.00 | 0.00 | 0.00 | 0.55 |
| 32 | Example | 0.50 | 0.00 | 0.00 | 0.00 | 0.00 | 0.00 | 0.45 | 0.00 | 0.00 | 0.00 | 0.00 | 0.45 |
| 33 | Comparative example | 0.50 | 0.00 | 0.00 | 0.00 | 0.00 | 0.00 | 0.55 | 0.00 | 0.00 | 0.00 | 0.00 | 0.55 |
| 34 | Example | 0.50 | 0.00 | 0.00 | 0.00 | 0.00 | 0.00 | 0.00 | 0.45 | 0.00 | 0.00 | 0.00 | 0.45 |
| 35 | Comparative example | 0.50 | 0.00 | 0.00 | 0.00 | 0.00 | 0.00 | 0.00 | 0.55 | 0.00 | 0.00 | 0.00 | 0.55 |
| 36 | Example | 0.50 | 0.00 | 0.00 | 0.00 | 0.00 | 0.00 | 0.00 | 0.00 | 0.45 | 0.00 | 0.00 | 0.45 |
| 37 | Comparative example | 0.50 | 0.00 | 0.00 | 0.00 | 0.00 | 0.00 | 0.00 | 0.00 | 0.55 | 0.00 | 0.00 | 0.55 |

TABLE 4b

| No. | Remarks | Components | | | | | | | | | | | |
|---|---|---|---|---|---|---|---|---|---|---|---|---|---|
| | | Fe | Sr | Sb | Pb | B | Li | Zr | Mo | W | Ag | P | Expression 2 |
| 38 | Example | 0.50 | 0.00 | 0.00 | 0.00 | 0.00 | 0.00 | 0.00 | 0.00 | 0.00 | 0.45 | 0.00 | 0.45 |
| 39 | Comparative example | 0.50 | 0.00 | 0.00 | 0.00 | 0.00 | 0.00 | 0.00 | 0.00 | 0.00 | 0.55 | 0.00 | 0.55 |
| 40 | Example | 0.50 | 0.00 | 0.00 | 0.00 | 0.00 | 0.00 | 0.00 | 0.00 | 0.00 | 0.00 | 0.45 | 0.45 |
| 41 | Comparative example | 0.50 | 0.00 | 0.00 | 0.00 | 0.00 | 0.00 | 0.00 | 0.00 | 0.00 | 0.00 | 0.55 | 0.55 |
| 42 | Comparative example | 1.50 | 0.15 | 0.10 | 0.00 | 0.20 | 0.00 | 0.00 | 0.00 | 0.00 | 0.00 | 0.10 | 0.55 |
| 43 | Example | 0.60 | 0.00 | 0.00 | 0.00 | 0.00 | 0.00 | 0.00 | 0.00 | 0.00 | 0.00 | 0.00 | 0.00 |
| 44 | Example | 0.60 | 0.00 | 0.00 | 0.00 | 0.00 | 0.00 | 0.00 | 0.00 | 0.00 | 0.00 | 0.00 | 0.00 |
| 45 | Example | 0.60 | 0.00 | 0.00 | 0.00 | 0.00 | 0.00 | 0.00 | 0.00 | 0.00 | 0.00 | 0.00 | 0.00 |
| 46 | Example | 0.60 | 0.00 | 0.00 | 0.00 | 0.00 | 0.00 | 0.00 | 0.00 | 0.00 | 0.00 | 0.00 | 0.00 |
| 47 | Comparative example | 0.60 | 0.00 | 0.00 | 0.00 | 0.00 | 0.00 | 0.00 | 0.00 | 0.00 | 0.00 | 0.00 | 0.00 |
| 48 | Comparative example | 0.60 | 0.00 | 0.00 | 0.00 | 0.00 | 0.00 | 0.00 | 0.00 | 0.00 | 0.00 | 0.00 | 0.00 |
| 49 | Example | 0.60 | 0.00 | 0.00 | 0.00 | 0.00 | 0.00 | 0.00 | 0.00 | 0.00 | 0.00 | 0.00 | 0.00 |
| 50 | Comparative example | 0.60 | 0.00 | 0.00 | 0.00 | 0.00 | 0.00 | 0.00 | 0.00 | 0.00 | 0.00 | 0.00 | 0.00 |
| 51 | Comparative example | 0.60 | 0.00 | 0.00 | 0.00 | 0.00 | 0.00 | 0.00 | 0.00 | 0.00 | 0.00 | 0.00 | 0.00 |
| 52 | Example | 0.60 | 0.00 | 0.00 | 0.00 | 0.00 | 0.00 | 0.00 | 0.00 | 0.00 | 0.00 | 0.00 | 0.00 |
| 53 | Example | 0.60 | 0.00 | 0.00 | 0.00 | 0.00 | 0.00 | 0.00 | 0.00 | 0.00 | 0.00 | 0.00 | 0.00 |
| 54 | Comparative example | 0.60 | 0.00 | 0.00 | 0.00 | 0.00 | 0.00 | 0.00 | 0.00 | 0.00 | 0.00 | 0.00 | 0.00 |
| 55 | Comparative example | 0.60 | 0.00 | 0.00 | 0.00 | 0.00 | 0.00 | 0.00 | 0.00 | 0.00 | 0.00 | 0.00 | 0.00 |
| 56 | Example | 0.40 | 0.00 | 0.00 | 0.00 | 0.00 | 0.00 | 0.00 | 0.00 | 0.00 | 0.00 | 0.00 | 0.00 |
| 57 | Example | 0.50 | 0.00 | 0.00 | 0.00 | 0.00 | 0.00 | 0.00 | 0.00 | 0.00 | 0.00 | 0.00 | 0.00 |
| 58 | Example | 0.50 | 0.00 | 0.00 | 0.00 | 0.00 | 0.00 | 0.00 | 0.00 | 0.00 | 0.00 | 0.00 | 0.00 |
| 59 | Comparative example | 0.50 | 0.00 | 0.00 | 0.00 | 0.00 | 0.00 | 0.00 | 0.00 | 0.00 | 0.00 | 0.00 | 0.00 |
| 60 | Example | 0.70 | 0.00 | 0.45 | 0.00 | 0.00 | 0.00 | 0.00 | 0.00 | 0.00 | 0.00 | 0.00 | 0.45 |
| 61 | Example | 0.70 | 0.00 | 0.35 | 0.10 | 0.00 | 0.00 | 0.00 | 0.00 | 0.00 | 0.00 | 0.00 | 0.45 |
| 62 | Comparative example | 0.70 | 0.00 | 0.55 | 0.00 | 0.00 | 0.00 | 0.00 | 0.00 | 0.00 | 0.00 | 0.00 | 0.55 |
| 63 | Example | 0.70 | 0.00 | 0.00 | 0.00 | 0.00 | 0.00 | 0.00 | 0.00 | 0.00 | 0.00 | 0.00 | 0.00 |
| 64 | Comparative example | 0.70 | 0.00 | 0.00 | 0.00 | 0.00 | 0.00 | 0.00 | 0.00 | 0.00 | 0.00 | 0.00 | 0.00 |
| 65 | Comparative example | 0.70 | 0.00 | 0.00 | 0.00 | 0.00 | 0.00 | 0.00 | 0.00 | 0.00 | 0.00 | 0.00 | 0.00 |
| 66 | Comparative example | 0.70 | 0.00 | 0.00 | 0.00 | 0.00 | 0.00 | 0.00 | 0.00 | 0.00 | 0.00 | 0.00 | 0.00 |
| 67 | Comparative example | 0.60 | 0.00 | 0.00 | 0.00 | 0.00 | 0.00 | 0.00 | 0.00 | 0.00 | 0.00 | 0.00 | 0.00 |
| 68 | Example | 0.60 | 0.00 | 0.00 | 0.00 | 0.00 | 0.00 | 0.00 | 0.00 | 0.00 | 0.00 | 0.00 | 0.00 |
| 69 | Comparative example | 0.60 | 0.00 | 0.00 | 0.00 | 0.00 | 0.00 | 0.00 | 0.00 | 0.00 | 0.00 | 0.00 | 0.00 |

TABLE 4b-continued

| No. | Remarks | Components | | | | | | | | | | | |
|---|---|---|---|---|---|---|---|---|---|---|---|---|---|
| | | Fe | Sr | Sb | Pb | B | Li | Zr | Mo | W | Ag | P | Expression 2 |
| 70 | Comparative example | 0.50 | 0.00 | 0.00 | 0.00 | 0.00 | 0.00 | 0.00 | 0.00 | 0.00 | 0.00 | 0.00 | 0.00 |
| 71 | Comparative example | 0.60 | 0.00 | 0.00 | 0.00 | 0.00 | 0.00 | 0.00 | 0.00 | 0.00 | 0.00 | 0.00 | 0.00 |
| 72 | Example | 0.50 | 0.00 | 0.00 | 0.00 | 0.00 | 0.00 | 0.00 | 0.00 | 0.00 | 0.00 | 0.00 | 0.00 |
| 73 | Example | 0.90 | 0.00 | 0.00 | 0.00 | 0.00 | 0.00 | 0.00 | 0.00 | 0.00 | 0.00 | 0.00 | 0.00 |
| 74 | Example | 0.80 | 0.00 | 0.00 | 0.00 | 0.00 | 0.00 | 0.00 | 0.00 | 0.00 | 0.00 | 0.00 | 0.00 |

TABLE 4c

| No. | Remarks | Components | | | | | | | | | | | |
|---|---|---|---|---|---|---|---|---|---|---|---|---|---|
| | | Fe | Sr | Sb | Pb | B | Li | Zr | Mo | W | Ag | P | Expression 2 |
| 75 | Example | 0.70 | 0.00 | 0.00 | 0.00 | 0.00 | 0.00 | 0.00 | 0.00 | 0.00 | 0.00 | 0.00 | 0.00 |
| 76 | Example | 0.80 | 0.10 | 0.00 | 0.00 | 0.00 | 0.00 | 0.00 | 0.00 | 0.00 | 0.00 | 0.00 | 0.10 |
| 77 | Example | 0.90 | 0.00 | 0.00 | 0.00 | 0.00 | 0.00 | 0.00 | 0.00 | 0.00 | 0.00 | 0.00 | 0.00 |
| 78 | Example | 0.90 | 0.00 | 0.00 | 0.00 | 0.00 | 0.00 | 0.00 | 0.00 | 0.00 | 0.00 | 0.00 | 0.00 |
| 79 | Example | 0.90 | 0.00 | 0.00 | 0.00 | 0.00 | 0.00 | 0.00 | 0.00 | 0.00 | 0.00 | 0.00 | 0.00 |
| 80 | Comparative example | 0.90 | 0.00 | 0.00 | 0.00 | 0.00 | 0.00 | 0.00 | 0.00 | 0.00 | 0.00 | 0.00 | 0.00 |
| 81 | Comparative example | 0.90 | 0.00 | 0.00 | 0.00 | 0.00 | 0.00 | 0.00 | 0.00 | 0.00 | 0.00 | 0.00 | 0.00 |
| 82 | Example | 0.90 | 0.00 | 0.00 | 0.00 | 0.00 | 0.00 | 0.00 | 0.00 | 0.00 | 0.00 | 0.00 | 0.00 |
| 83 | Comparative example | 0.90 | 0.00 | 0.00 | 0.00 | 0.00 | 0.00 | 0.00 | 0.00 | 0.00 | 0.00 | 0.00 | 0.00 |
| 84 | Comparative example | 0.90 | 0.00 | 0.00 | 0.00 | 0.00 | 0.00 | 0.00 | 0.00 | 0.00 | 0.00 | 0.00 | 0.00 |
| 85 | Example | 0.90 | 0.00 | 0.00 | 0.00 | 0.00 | 0.00 | 0.00 | 0.00 | 0.00 | 0.00 | 0.00 | 0.00 |
| 86 | Example | 0.90 | 0.00 | 0.00 | 0.00 | 0.00 | 0.00 | 0.00 | 0.00 | 0.00 | 0.00 | 0.00 | 0.00 |
| 87 | Comparative example | 0.90 | 0.00 | 0.00 | 0.00 | 0.00 | 0.00 | 0.00 | 0.00 | 0.00 | 0.00 | 0.00 | 0.00 |
| 88 | Comparative example | 0.90 | 0.00 | 0.00 | 0.00 | 0.00 | 0.00 | 0.00 | 0.00 | 0.00 | 0.00 | 0.00 | 0.00 |
| 89 | Example | 0.70 | 0.00 | 0.00 | 0.00 | 0.00 | 0.00 | 0.00 | 0.00 | 0.00 | 0.00 | 0.00 | 0.00 |
| 90 | Comparative example | 0.70 | 0.00 | 0.00 | 0.00 | 0.00 | 0.00 | 0.00 | 0.00 | 0.00 | 0.00 | 0.00 | 0.00 |
| 91 | Comparative example | 0.70 | 0.00 | 0.00 | 0.00 | 0.00 | 0.00 | 0.00 | 0.00 | 0.00 | 0.00 | 0.00 | 0.00 |
| 92 | Comparative example | 0.80 | 0.00 | 0.00 | 0.00 | 0.00 | 0.00 | 0.00 | 0.00 | 0.00 | 0.00 | 0.00 | 0.00 |
| 93 | Example | 0.80 | 0.00 | 0.00 | 0.00 | 0.00 | 0.00 | 0.00 | 0.00 | 0.00 | 0.00 | 0.00 | 0.00 |
| 94 | Comparative example | 1.00 | 0.00 | 0.00 | 0.00 | 0.00 | 0.00 | 0.00 | 0.00 | 0.00 | 0.00 | 0.00 | 0.00 |
| 95 | Example | 1.00 | 0.00 | 0.00 | 0.00 | 0.00 | 0.00 | 0.00 | 0.00 | 0.00 | 0.00 | 0.00 | 0.00 |
| 96 | Comparative example | 0.90 | 0.00 | 0.00 | 0.00 | 0.00 | 0.00 | 0.00 | 0.00 | 0.00 | 0.00 | 0.00 | 0.00 |
| 97 | Comparative example | 1.00 | 0.00 | 0.00 | 0.00 | 0.00 | 0.00 | 0.00 | 0.00 | 0.00 | 0.00 | 0.00 | 0.00 |
| 98 | Example | 1.00 | 0.00 | 0.00 | 0.00 | 0.00 | 0.00 | 0.00 | 0.00 | 0.00 | 0.00 | 0.00 | 0.00 |
| 99 | Example | 4.50 | 0.00 | 0.00 | 0.00 | 0.49 | 0.00 | 0.00 | 0.00 | 0.00 | 0.00 | 0.00 | 0.49 |
| 100 | Comparative example | 4.50 | 0.00 | 0.00 | 0.00 | 0.55 | 0.00 | 0.00 | 0.00 | 0.00 | 0.00 | 0.00 | 0.55 |
| 101 | Comparative example | 4.90 | 0.00 | 0.00 | 0.00 | 0.49 | 0.00 | 0.00 | 0.00 | 0.00 | 0.00 | 0.00 | 0.49 |
| 102 | Example | 1.20 | 0.30 | 0.10 | 0.00 | 0.00 | 0.00 | 0.00 | 0.00 | 0.00 | 0.00 | 0.00 | 0.40 |
| 103 | Comparative example | 1.20 | 0.30 | 0.10 | 0.00 | 0.00 | 0.00 | 0.00 | 0.00 | 0.00 | 0.00 | 0.00 | 0.40 |
| 104 | Comparative example | 1.20 | 0.30 | 0.10 | 0.00 | 0.00 | 0.00 | 0.00 | 0.00 | 0.00 | 0.00 | 0.00 | 0.40 |
| 105 | Example | 1.20 | 0.30 | 0.10 | 0.00 | 0.00 | 0.00 | 0.00 | 0.00 | 0.00 | 0.00 | 0.00 | 0.40 |
| 106 | Example | 1.20 | 0.35 | 0.10 | 0.00 | 0.00 | 0.00 | 0.00 | 0.00 | 0.00 | 0.00 | 0.00 | 0.45 |
| 107 | Comparative example | 1.20 | 0.55 | 0.00 | 0.00 | 0.00 | 0.00 | 0.00 | 0.00 | 0.00 | 0.00 | 0.00 | 0.55 |
| 108 | Example | 3.00 | 0.00 | 0.00 | 0.00 | 0.00 | 0.00 | 0.00 | 0.00 | 0.00 | 0.00 | 0.00 | 0.00 |
| 109 | Comparative example | 3.00 | 0.00 | 0.00 | 0.00 | 0.00 | 0.00 | 0.00 | 0.00 | 0.00 | 0.00 | 0.00 | 0.00 |
| 110 | Comparative example | 5.10 | 0.00 | 0.00 | 0.00 | 0.00 | 0.00 | 0.00 | 0.00 | 0.00 | 0.00 | 0.00 | 0.00 |
| 111 | Comparative example | 1.90 | 0.00 | 0.00 | 0.00 | 0.00 | 0.00 | 0.00 | 0.00 | 0.00 | 0.00 | 0.00 | 0.00 |

TABLE 5a

| No. | Remarks | Expression 3 | Expression 6 | Expression 4 | Expression 5 | Performance evaluation: Planar portion Corrosion resist | Cut end surface Red rust area ratio | 1 T bent portion Corrosion resist |
|---|---|---|---|---|---|---|---|---|
| 1 | Comparative example | 0.290 | 0.143 | 0.34 | 0.38 | B | B | B |
| 2 | Comparative example | 0.288 | 0.145 | 0.37 | 0.38 | B | B | B |
| 3 | Comparative example | 0.282 | 0.130 | 0.51 | 0.35 | B | B | B |
| 4 | Example | 0.140 | 0.350 | 1.01 | 1.01 | A | A | S |
| 5 | Example | 0.138 | 0.351 | 1.12 | 1.19 | A | S | S |
| 6 | Example | 0.138 | 0.151 | 0.90 | 1.05 | AAA | S | AAA |
| 7 | Example | 0.232 | 0.353 | 1.19 | 1.51 | AAA | AAA | AAA |
| 8 | Example | 0.135 | 0.167 | 1.35 | 1.40 | AAA | AAA | AAA |
| 9 | Example | 0.138 | 0.355 | 1.51 | 1.29 | AAA | AAA | S |
| 10 | Example | 0.259 | 0.161 | 1.01 | 0.65 | AAA | AAA | A |
| 11 | Example | 0.245 | 0.375 | 1.35 | 1.36 | AAA | AAA | AAA |
| 12 | Comparative example | 0.290 | 0.120 | 0.56 | 0.61 | B | B | B |
| 13 | Comparative example | 0.310 | 0.131 | 0.48 | 0.59 | B | B | B |
| 14 | Example | 0.231 | 0.362 | 0.48 | 1.01 | AAA | AAA | AA |
| 15 | Comparative example | 0.288 | 0.139 | 0.88 | 0.81 | B | B | B |
| 16 | Comparative example | 0.275 | 0.141 | 0.81 | 0.78 | B | B | B |
| 17 | Example | 0.126 | 0.210 | 1.71 | 1.76 | AAA | AAA | AAA |
| 18 | Example | 0.124 | 0.256 | 1.71 | 1.69 | AAA | AAA | AAA |
| 19 | Comparative example | 0.323 | 0.105 | 0.91 | 0.91 | B | B | B |
| 20 | Comparative example | 0.292 | 0.124 | 0.71 | 0.73 | B | B | B |
| 21 | Example | 0.135 | 0.224 | 1.81 | 1.97 | A | A | AAA |
| 22 | Example | 0.135 | 0.371 | 1.84 | 1.88 | S | S | S |
| 23 | Comparative example | 0.331 | 0.125 | 0.91 | 0.69 | B | S | B |
| 24 | Example | 0.104 | 0.510 | 1.95 | 2.01 | AAA | AAA | S |
| 25 | Comparative example | 0.271 | 0.121 | 0.89 | 0.87 | B | B | B |
| 26 | Comparative example | 0.291 | 0.140 | 0.81 | 0.78 | B | B | B |
| 27 | Comparative example | 0.284 | 0.135 | 0.84 | 0.82 | B | B | B |
| 28 | Example | 0.070 | 0.591 | 2.22 | 3.33 | A | A | S |
| 29 | Example | 0.062 | 0.590 | 2.38 | 3.68 | A | A | S |
| 30 | Example | 0.058 | 0.601 | 3.71 | 2.98 | AA | A | S |
| 31 | Comparative example | 0.284 | 0.140 | 0.88 | 0.97 | B | B | B |
| 32 | Example | 0.059 | 0.621 | 4.15 | 3.54 | AA | A | S |
| 33 | Comparative example | 0.296 | 0.125 | 0.89 | 0.81 | B | B | B |
| 34 | Example | 0.070 | 0.633 | 4.21 | 4.00 | AA | A | S |
| 35 | Comparative example | 0.294 | 0.135 | 0.81 | 0.91 | B | B | B |
| 36 | Example | 0.069 | 0.598 | 3.95 | 3.71 | AA | A | S |
| 37 | Comparative example | 0.275 | 0.142 | 0.91 | 0.98 | B | B | B |

TABLE 5b

| No. | Remarks | Expression 3 | Expression 6 | Expression 4 | Expression 5 | Performance evaluation: Planar portion Corrosion resist | Cut end surface Red rust area ratio | 1 T bent portion Corrosion resist |
|---|---|---|---|---|---|---|---|---|
| 38 | Example | 0.071 | 0.602 | 1.98 | 2.18 | AA | A | S |
| 39 | Comparative example | 0.281 | 0.139 | 0.92 | 0.88 | B | B | B |
| 40 | Example | 0.069 | 0.631 | 3.25 | 3.61 | AA | A | S |
| 41 | Comparative example | 0.274 | 0.129 | 0.79 | 0.81 | B | B | B |

TABLE 5b-continued

| No. | Remarks | Expression 3 | Expression 6 | Expression 4 | Expression 5 | Performance evaluation: Planar portion Corrosion resist | Cut end surface Red rust area ratio | 1 T bent portion Corrosion resist |
|---|---|---|---|---|---|---|---|---|
| 42 | Comparative example | 0.268 | 0.133 | 0.95 | 0.91 | B | B | B |
| 43 | Example | 0.081 | 0.687 | 5.98 | 6.01 | AAA | S | S |
| 44 | Example | 0.059 | 0.341 | 4.95 | 5.21 | AAA | AAA | AAA |
| 45 | Example | 0.044 | 0.660 | 5.10 | 3.91 | AAA | AAA | S |
| 46 | Example | 0.151 | 0.630 | 5.99 | 4.50 | AAA | AAA | AAA |
| 47 | Comparative example | 0.288 | 0.135 | 0.91 | 0.93 | B | B | B |
| 48 | Comparative example | 0.305 | 0.141 | 0.89 | 0.92 | B | B | B |
| 49 | Example | 0.230 | 0.601 | 1.25 | 0.79 | AAA | AAA | AA |
| 50 | Comparative example | 0.309 | 0.146 | 0.91 | 0.93 | B | B | B |
| 51 | Comparative example | 0.301 | 0.141 | 0.69 | 0.88 | B | B | B |
| 52 | Example | 0.066 | 0.344 | 3.56 | 3.33 | AAA | AAA | AAA |
| 53 | Example | 0.049 | 0.630 | 3.72 | 3.65 | AAA | AAA | S |
| 54 | Comparative example | 0.291 | 0.140 | 0.98 | 0.79 | B | B | B |
| 55 | Comparative example | 0.280 | 0.144 | 0.85 | 0.79 | B | B | B |
| 56 | Example | 0.089 | 0.348 | 2.36 | 2.32 | AAA | AAA | AAA |
| 57 | Example | 0.084 | 0.346 | 2.65 | 2.55 | A | A | AAA |
| 58 | Example | 0.071 | 0.456 | 2.32 | 1.88 | AAA | S | S |
| 59 | Comparative example | 0.274 | 0.139 | 0.88 | 0.84 | B | B | B |
| 60 | Example | 0.132 | 0.499 | 1.68 | 1.57 | S | AAA | S |
| 61 | Example | 0.131 | 0.495 | 1.88 | 1.87 | S | AAA | S |
| 62 | Comparative example | 0.278 | 0.099 | 0.87 | 0.95 | B | B | B |
| 63 | Example | 0.121 | 0.496 | 1.78 | 1.69 | AAA | S | S |
| 64 | Comparative example | 0.284 | 0.101 | 0.99 | 0.69 | B | B | B |
| 65 | Comparative example | 0.284 | 0.131 | 0.91 | 0.67 | B | B | B |
| 66 | Comparative example | 0.268 | 0.121 | 0.79 | 0.57 | B | B | B |
| 67 | Comparative example | 0.269 | 0.125 | 0.68 | 0.54 | B | B | B |
| 68 | Example | 0.118 | 0.395 | 1.69 | 1.34 | AAA | S | S |
| 69 | Comparative example | 0.280 | 0.098 | 0.45 | 0.68 | B | B | B |
| 70 | Comparative example | 0.269 | 0.099 | 0.35 | 0.81 | B | B | B |
| 71 | Comparative example | 0.291 | 0.105 | 0.38 | 0.89 | B | B | B |
| 72 | Example | 0.133 | 0.400 | 1.53 | 1.56 | AAA | S | S |
| 73 | Example | 0.230 | 0.414 | 1.12 | 0.65 | AAA | AAA | AA |
| 74 | Example | 0.129 | 0.395 | 0.81 | 1.02 | AAA | AAA | AAA |

TABLE 5c

| No. | Remarks | Expression 3 | Expression 6 | Expression 4 | Expression 5 | Performance evaluation: Planar portion Corrosion resist | Cut end surface Red rust area ratio | 1 T bent portion Corrosion resist |
|---|---|---|---|---|---|---|---|---|
| 75 | Example | 0.245 | 0.388 | 1.46 | 1.15 | AAA | AAA | AAA |
| 76 | Example | 0.131 | 0.381 | 1.78 | 1.68 | S | S | S |
| 77 | Example | 0.130 | 0.295 | 1.90 | 1.57 | AAA | AAA | AAA |
| 78 | Example | 0.130 | 0.440 | 1.53 | 1.56 | S | S | S |
| 79 | Example | 0.246 | 0.450 | 1.35 | 1.61 | AAA | AAA | AAA |
| 80 | Comparative example | 0.280 | 0.092 | 0.21 | 0.36 | B | B | B |
| 81 | Comparative example | 0.291 | 0.088 | 0.42 | 0.51 | B | B | B |
| 82 | Example | 0.244 | 0.374 | 0.90 | 1.61 | AAA | AAA | AA |

TABLE 5c-continued

| No. | Remarks | Expression 3 | Expression 6 | Expression 4 | Expression 5 | Performance evaluation: Planar portion Corrosion resist | Cut end surface Red rust area ratio | 1 T bent portion Corrosion resist |
|---|---|---|---|---|---|---|---|---|
| 83 | Comparative example | 0.284 | 0.079 | 0.63 | 0.35 | B | B | B |
| 84 | Comparative example | 0.281 | 0.075 | 0.35 | 0.65 | B | B | B |
| 85 | Example | 0.131 | 0.271 | 2.00 | 1.65 | AAA | AAA | AAA |
| 86 | Example | 0.129 | 0.374 | 1.31 | 1.30 | AAA | AAA | S |
| 87 | Comparative example | 0.276 | 0.074 | 0.56 | 0.51 | B | B | B |
| 88 | Comparative example | 0.277 | 0.071 | 0.51 | 0.58 | B | B | B |
| 89 | Example | 0.135 | 0.352 | 1.35 | 1.31 | A | A | S |
| 90 | Comparative example | 0.281 | 0.074 | 0.51 | 0.64 | B | B | B |
| 91 | Comparative example | 0.281 | 0.071 | 0.49 | 0.38 | B | B | B |
| 92 | Comparative example | 0.299 | 0.066 | 0.35 | 0.45 | B | B | B |
| 93 | Example | 0.130 | 0.358 | 1.63 | 1.23 | AAA | S | S |
| 94 | Comparative example | 0.299 | 0.066 | 0.45 | 0.45 | B | B | B |
| 95 | Example | 0.130 | 0.370 | 1.32 | 1.14 | A | S | S |
| 96 | Comparative example | 0.311 | 0.078 | 0.55 | 0.33 | B | B | B |
| 97 | Comparative example | 0.301 | 0.081 | 0.47 | 0.56 | AAA | B | B |
| 98 | Example | 0.133 | 0.371 | 1.59 | 1.02 | AAA | AAA | S |
| 99 | Example | 0.127 | 0.377 | 2.05 | 1.11 | AA | AA | S |
| 100 | Comparative example | 0.299 | 0.069 | 0.91 | 0.51 | B | B | B |
| 101 | Comparative example | 0.297 | 0.077 | 0.91 | 0.65 | AA | B | B |
| 102 | Example | 0.130 | 0.271 | 2.31 | 1.15 | S | AAA | AAA |
| 103 | Comparative example | 0.333 | 0.055 | 0.95 | 0.14 | B | B | B |
| 104 | Comparative example | 0.345 | 0.051 | 0.95 | 0.13 | B | B | B |
| 105 | Example | 0.129 | 0.379 | 2.25 | 0.88 | S | AAA | AAA |
| 106 | Example | 0.127 | 0.246 | 2.95 | 0.51 | S | AAA | AAA |
| 107 | Comparative example | 0.300 | 0.055 | 0.95 | 0.12 | B | B | B |
| 108 | Example | 0.126 | 0.369 | 1.98 | 1.01 | A | AA | S |
| 109 | Comparative example | 0.294 | 0.041 | 0.80 | 0.25 | B | B | B |
| 110 | Comparative example | 0.288 | 0.051 | 0.65 | 0.21 | B | B | B |
| 111 | Comparative example | 0.279 | 0.046 | 0.95 | 0.20 | B | B | B |

As can be understood from the results of the examples, the plated steel according to the present invention has excellent corrosion resistance and is particularly excellent in corrosion resistance of a processed portion.

INDUSTRIAL APPLICABILITY

The present invention can provide a plated steel excellent in corrosion resistance of a processed portion, and therefore its industrial applicability is high.

The invention claimed is:

1. A plated steel comprising a plated layer on a surface of a steel, wherein an average chemical composition of the plated layer is formed of, by mass %, 50.00% or more of Zn, more than 10.00% and less than 40.00% of Al, more than 5.00% and less than 12.50% of Mg, 0% or more and 3.00% or less of Sn, 0% or more and 1.00% or less of Bi, 0% or more and 1.00% or less of In, 0.03% or more and 2.00% or less of Ca, 0% or more and 0.50% or less of Y, 0% or more and 0.50% or less of La, 0% or more and 0.50% or less of Ce, 0% or more and 2.50% or less of Si, 0% or more and 0.25% or less of Cr, 0% or more and 0.25% or less of Ti, 0% or more and 0.25% or less of Ni, 0% or more and 0.25% or less of Co, 0% or more and 0.25% or less of V, 0% or more and 0.25% or less of Nb, 0% or more and 0.25% or less of Cu, 0% or more and 0.25% or less of Mn, more than 0% and 5.00% or less of Fe, 0% or more and 0.50% or less of Sr, 0% or more and 0.50% or less of Sb, 0% or more and 0.50% or less of Pb, 0% or more and 0.50% or less of B,
0% or more and 0.50% or less of Li,
0% or more and 0.50% or less of Zr,
0% or more and 0.50% or less of Mo,
0% or more and 0.50% or less of W,
0% or more and 0.50% or less of Ag,
0% or more and 0.50% or less of P,
and impurities,
the following Expression 1 and Expression 2 are satisfied, and
Expression 3 and Expression 6 are further satisfied in an X-ray diffraction pattern of a surface of the plated layer measured using Cu-Kα rays under a condition that an X-ray output is 40 kV and 150 mA, $$0 \leq Cr+Ti+Ni+Co+V+Nb+Cu+Mn \leq 0.25 \quad \text{Expression 1}$$

$$0 \leq Sr+Sb+Pb+B+Li+Zr+Mo+W+Ag+P \leq 0.50 \quad \text{Expression 2}$$

$$I(MgZn_2(41.31°))/I\Sigma(MgZn_2) \leq 0.265 \quad \text{Expression 3}$$

$$0.150 \leq \{I(MgZn_2(20.79°))+I(MgZn_2(42.24°))\}/I\Sigma(MgZn_2) \quad \text{Expression 6}$$

(Here, this is provided that the element symbols in Expression 1 and Expression 2 each indicate an amount (mass %) of each element by mass % in the plated layer, and 0 is substituted when the element is not contained, and
$I\Sigma(MgZn_2)$, $I(MgZn_2\ (41.31°))$, $I(MgZn_2\ (20.79°))$, and $I(MgZn_2\ (42.24°))$ in Expression 3 and Expression 6 are as follows, and $I\Sigma(Mg_2Sn)$ is 0 when the plated layer does not contain Sn,
$I\Sigma(MgZn_2)$: A sum of intensities of diffraction peaks of a (100) plane, a (002) plane, a (101) plane, a (102) plane, a (110) plane, a (103) plane, a (112) plane, a (201) plane, a (004) plane, a (203) plane, a (213) plane, a (220) plane, a (313) plane, and a (402) plane of $MgZn_2$,
$I(MgZn_2\ (41.31°))$: An intensity of the diffraction peak of the (201) plane of $MgZn_2$,
$I(MgZn_2\ (20.79°))$: An intensity of the diffraction peak of the (002) plane of $MgZn_2$,
$I(MgZn_2\ (42.24°))$: An intensity of the diffraction peak of the (004) plane of $MgZn_2$).

2. The plated steel according to claim 1, wherein an average composition of Sn of the plated layer is
0.03% or more and 1.50% or less of Sn.

3. The plated steel according to claim 1, wherein Expression 4 and Expression 5 are further satisfied in an X-ray diffraction image of the surface of the plated layer measured using Cu-Kα rays under a condition that an X-ray output is 40 kV and 150 mA, $$1.0 \leq I(Al0.71Zn0.29(38.78°))/I(Al(38.47°)) \quad \text{Expression 4}$$

$$1.0 \leq I((Al0.71Zn0.29(38.78°))/I(Zn(38.99°)) \quad \text{Expression 5}$$

(Here, $I(Al0.71Zn0.29\ (38.78°))$, $I(Al\ (38.47°))$, and $I(Zn\ (38.99°))$ in Expression 4 and Expression 5 are as follows,
$I(Al0.71Zn0.29\ (38.78°))$: An intensity of a diffraction peak of a (101) plane of Al0.71Zn0.29,
$I(Al\ (38.47°))$: An intensity of a diffraction peak of a (111) plane of Al,
$I(Zn\ (38.99°))$: An intensity of a diffraction peak of a (100) plane of Zn).

4. The plated steel according to claim 1, wherein the following Expression 3' is satisfied instead of the Expression 3, $$I(MgZn_2(41.31°))/I\Sigma(MgZn_2) \leq 0.140 \quad \text{Expression 3',}$$

5. The plated steel according to claim 1, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6',}$$

6. The plated steel according to claim 2, wherein Expression 4 and Expression 5 are further satisfied in an X-ray diffraction image of the surface of the plated layer measured using Cu-Kα rays under a condition that an X-ray output is 40 kV and 150 mA, $$1.0 \leq I(Al0.71Zn0.29(38.78°))/I(Al(38.47°)) \quad \text{Expression 4}$$

$$1.0 \leq I((Al0.71Zn0.29(38.78°))/I(Zn(38.99°)) \quad \text{Expression 5}$$

(Here, $I(Al0.71Zn0.29\ (38.78°))$, $I(Al\ (38.47°))$, and $I(Zn\ (38.99°))$ in Expression 4 and Expression 5 are as follows,
$I(Al0.71Zn0.29\ (38.78°))$: An intensity of a diffraction peak of a (101) plane of Al0.71Zn0.29,
$I(Al\ (38.47°))$: An intensity of a diffraction peak of a (111) plane of Al,
$I(Zn\ (38.99°))$: An intensity of a diffraction peak of a (100) plane of Zn).

7. The plated steel according to claim 2, wherein the following Expression 3' is satisfied instead of the Expression 3, $$I(MgZn_2(41.31°))/I\Sigma(MgZn_2) \leq 0.140 \quad \text{Expression 3'.}$$

8. The plated steel according to claim 3, wherein the following Expression 3' is satisfied instead of the Expression 3, $$I(MgZn_2(41.31°))/I\Sigma(MgZn_2) \leq 0.140 \quad \text{Expression 3'.}$$

9. The plated steel according to claim 6, wherein the following Expression 3' is satisfied instead of the Expression 3, $$I(MgZn_2(41.31°))/I\Sigma(MgZn_2) \leq 0.140 \quad \text{Expression 3'.}$$

10. The plated steel according to claim 2, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

11. The plated steel according to claim 3, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

12. The plated steel according to claim 4, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

13. The plated steel according to claim 6, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

14. The plated steel according to claim 7, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

15. The plated steel according to claim 8, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

16. The plated steel according to claim 9, wherein the following Expression 6' is satisfied instead of the Expression 6, $$0.350 \leq \{I(MgZn_2(20.79°))+I(MgZn_2(42.24°))\}/I\Sigma(MgZn_2) \quad \text{Expression 6'.}$$

* * * * *